US011004428B2

(12) United States Patent
Kim et al.

(10) Patent No.: US 11,004,428 B2
(45) Date of Patent: May 11, 2021

(54) ELECTRONIC DEVICE AND METHOD OF PARTIALLY UPDATING SCREEN USING SAME

(71) Applicant: Samsung Electronics Co., Ltd., Gyeonggi-do (KR)

(72) Inventors: Seungjin Kim, Gyeonggi-do (KR); Joonyung Park, Gyeonggi-do (KR); Kwangrae Cho, Gyeonggi-do (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/558,904

(22) Filed: Sep. 3, 2019

(65) Prior Publication Data

US 2020/0074963 A1 Mar. 5, 2020

(30) Foreign Application Priority Data

Sep. 1, 2018 (KR) ..... 10-2018-0104152

(51) Int. Cl.
*G09G 5/397* (2006.01)
*G09G 5/393* (2006.01)
*G09G 5/14* (2006.01)

(52) U.S. Cl.
CPC ..... *G09G 5/397* (2013.01); *G09G 5/393* (2013.01); *G09G 2340/10* (2013.01); *G09G 2340/12* (2013.01)

(58) Field of Classification Search
CPC ..... G09G 2310/04; G09G 2330/021; G09G 2340/10; G09G 2340/12; G09G 5/14; G09G 5/393; G09G 5/397
See application file for complete search history.

(56) References Cited

U.S. PATENT DOCUMENTS

| | | | |
|---|---|---|---|
| 9,672,584 | B2 | 6/2017 | Metcalfe |
| 9,990,692 | B2 | 6/2018 | Metcalfe |
| 2004/0174385 | A1 | 9/2004 | Ikeda et al. |
| 2007/0195105 | A1 | 8/2007 | Koberg |
| 2010/0321402 | A1 | 12/2010 | Han et al. |
| 2011/0119355 | A1 | 5/2011 | Hwang |
| 2014/0215367 | A1 | 7/2014 | Kim et al. |

FOREIGN PATENT DOCUMENTS

| | | |
|---|---|---|
| EP | 1 378 884 | 1/2004 |
| KR | 1020050089646 | 9/2005 |
| KR | 1020170088232 | 8/2017 |

OTHER PUBLICATIONS

International Search Report dated Dec. 4, 2019 issued in counterpart application No. PCT/KR2019/010890, 3 pages.
European Search Report dated Jan. 21, 2020 issued in counterpart application No. 19194694.6-1210, 11 pages.

*Primary Examiner* — Sing-Wai Wu
(74) *Attorney, Agent, or Firm* — The Farrell Law Firm, P.C.

(57) ABSTRACT

Disclosed is an electronic device that includes a display, a memory, and a processor configured to combine a plurality of images based on an execution of a plurality of applications so that the plurality of images is displayed in a single screen form, identify coordinate information of a display area of each of a first image and a second image on the screen based on the first image and second image belonging to the plurality of images and being updated, store the first image and the second image in a contiguous address of the memory, and transmit the coordinate information of the display area of each of the first image and the second image and the stored first image and second image to the display.

16 Claims, 13 Drawing Sheets

ELECTRONIC DEVICE AND METHOD OF PARTIALLY UPDATING SCREEN USING SAME

CROSS-REFERENCE TO RELATED APPLICATION(S)

This application is based on and claims priority under 35 U.S.C. § 119 to Korean Patent Application No. 10-2018-0104152, filed on Sep. 1, 2018, in the Korean Intellectual Property Office, the disclosure of which is incorporated by reference herein in its entirety.

BACKGROUND

1. Field

The disclosure relates generally to an electronic device, and more particularly, to a method of partially updating a screen on an electronic device.

2. Description of Related Art

Various electronic devices, such as a smartphone, tablet personal computer (PC), portable multimedia player (PMP), personal digital assistant (PDA), laptop PC, and wearable device, have been introduced to provide various functions, such as a social network service (SNS), the Internet, multimedia, photographing and execution of photos and video, and document tasks, in addition to the telephone function.

The electronic device may execute a plurality of applications concurrently in response to a user input, and may display the output of the plurality of executed applications. If update occurs while the plurality of applications is executed, the electronic device may update the output of an application.

When a plurality of applications is displayed, however, current consumption and/or resource use of an electronic device may increase because the output of a non-updated application is updated in addition to the output of an updated application.

Therefore, there is a need in the art for a method and apparatus that distinguishes between an updated application and a non-updated application, when providing resources for use of the electronic device.

SUMMARY

Aspects of the disclosure are to address at least the above-mentioned problems and/or disadvantages and to provide at least the advantages described below. Accordingly, an aspect of the disclosure is to provide, an electronic device that may update only the output of an actually updated application.

In another aspect of the disclosure, when the update of at least two applications occurs during output based on the execution of a plurality of applications, the electronic device may perform the update of the at least two applications based on information on the coordinates of an image for the at least two applications.

In accordance with an aspect of the disclosure, an electronic device includes a display, a memory, and a processor operatively connected to the memory and the display, wherein the processor is configured to, combine a plurality of images based on an execution of a plurality of applications, resulting in the plurality of images being displayed in a single screen form, identify coordinate information of a display area of each of a first image and a second image on the screen based on the first image and second image belonging to the plurality of images and being updated, store the first image and the second image in a contiguous address of the memory, and transmit the coordinate information of the display area of each of the first image and the second image and the stored first image and second image to the display.

In accordance with another aspect of the disclosure, a method for an electronic device to partially update a screen includes combining a plurality of images based on an execution of a plurality of applications, resulting in the plurality of images being displayed in a single screen form, identifying coordinate information of a display area of each of a first image and a second image on the screen based on the first image and second image belonging to the plurality of images and being updated, storing the first image and the second image in a contiguous address of a memory, and transmitting the coordinate information of the display area of each of the first image and the second image and the stored first image and second image to the display.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
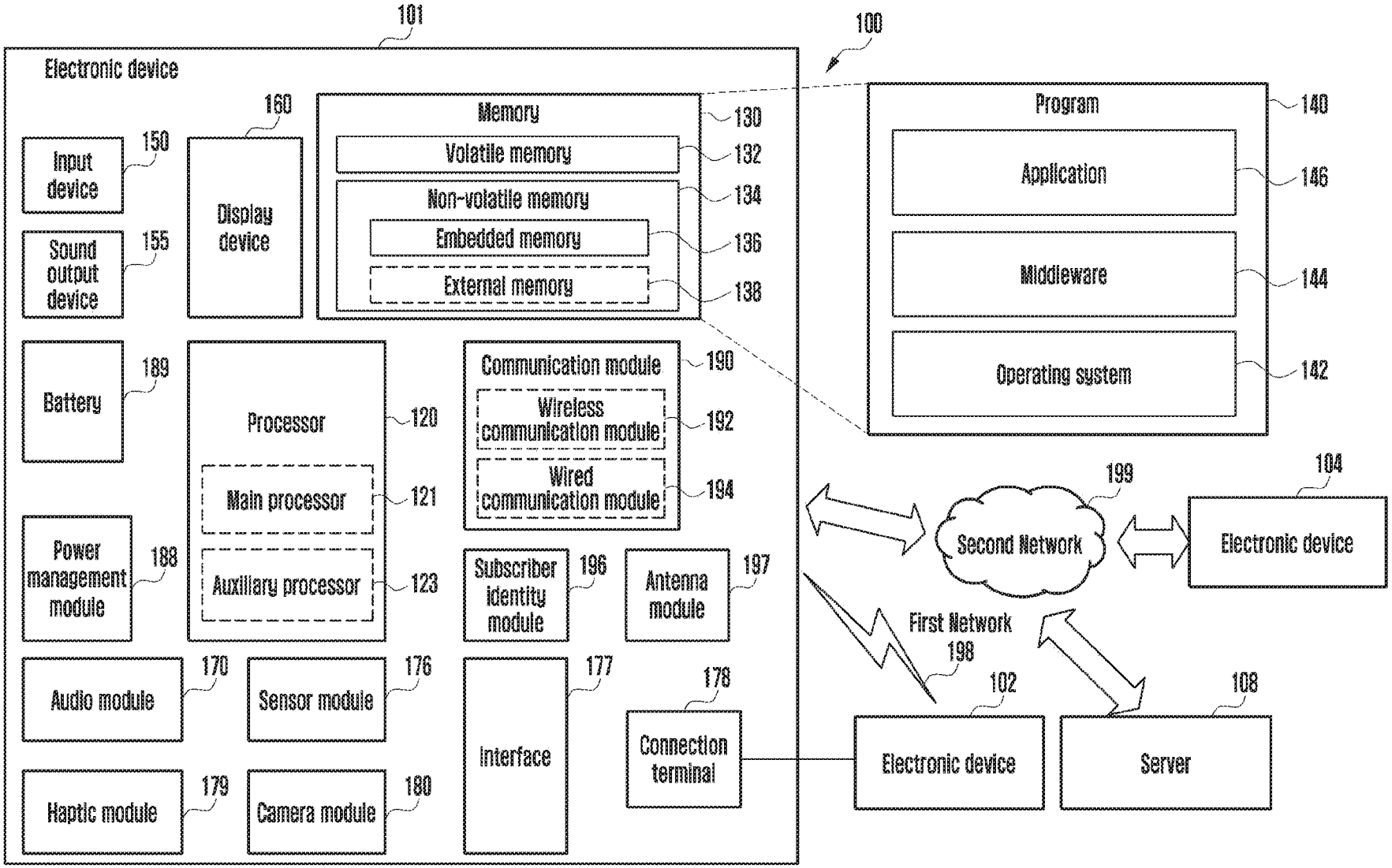
FIG. 1 is a block diagram of an electronic device in a network environment according to an embodiment.

Hereinafter, embodiments of the disclosure will be described with reference to accompanying drawings, in which a size of each component may be exaggerated for convenience. Detailed descriptions of known functions and configurations incorporated here will be omitted for the sake of clarity and conciseness.

The electronic device may be one of various types of electronic devices, such as a portable communication device, such as a smartphone a computer device, a portable multimedia device, a portable medical device, a camera, a wearable device, or a home appliance. However, the electronic devices are not limited to those described above.

It should be appreciated that embodiments of the present disclosure and the terms used therein are not intended to limit the technological features set forth herein to particular embodiments and include various changes, equivalents, or replacements for a corresponding embodiment.

In the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to distinguish a corresponding component from another, and do not limit the components in importance or order. It is to be understood that if an element, such as a first element, is referred to, with or without the term "operatively" or "communicatively", as "coupled with," "coupled to," "connected with," or "connected to" another element, such as a second element, the first element may be coupled with the second element wiredly, wirelessly, or via a third element.

FIG. 1 is a block diagram of an electronic device in a network environment according to various embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
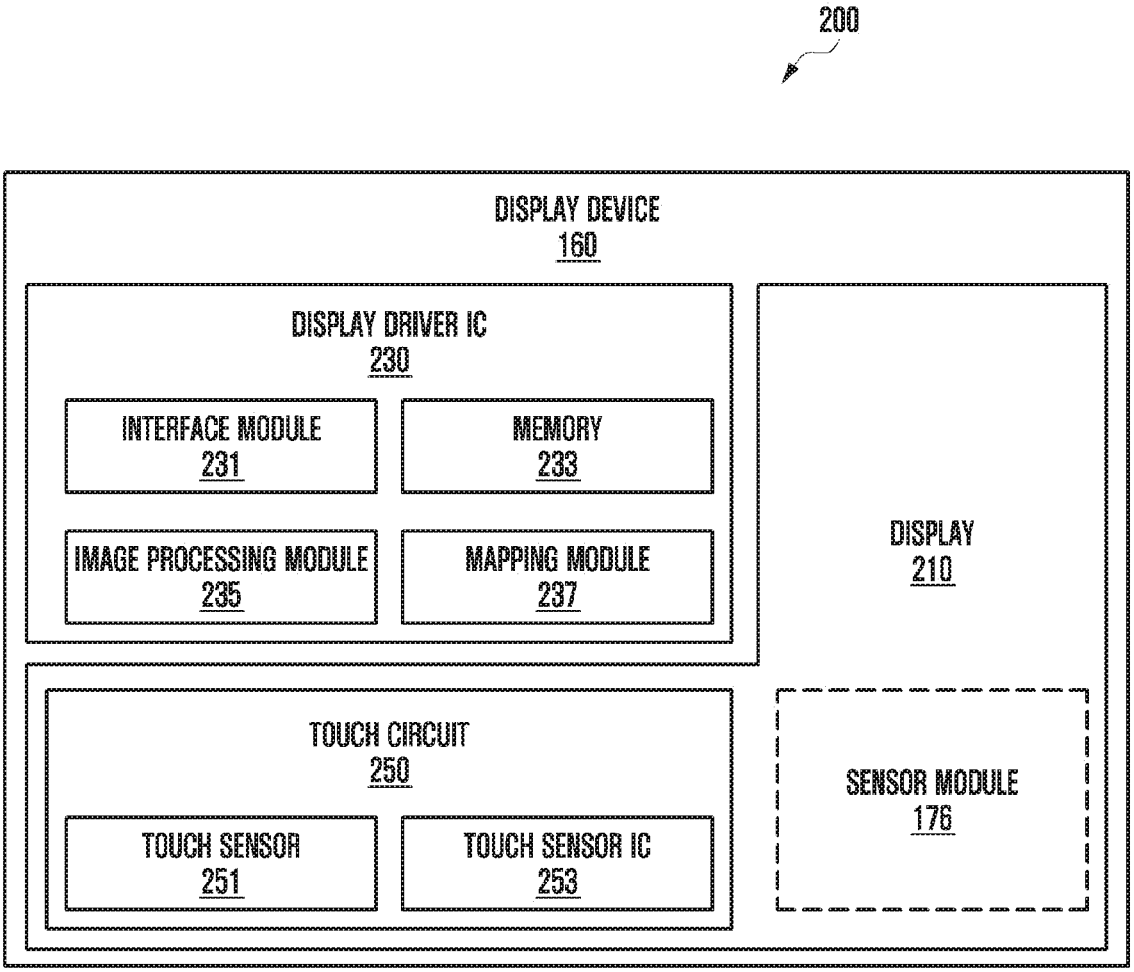
FIG. 2 is a block diagram of a display device according to an embodiment.

FIG. 2 is a block diagram of a display device according to various embodiments.

FIG. 2 is a block diagram 200 illustrating the display device 160 according to various embodiments. Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis.

The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210.

The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3:
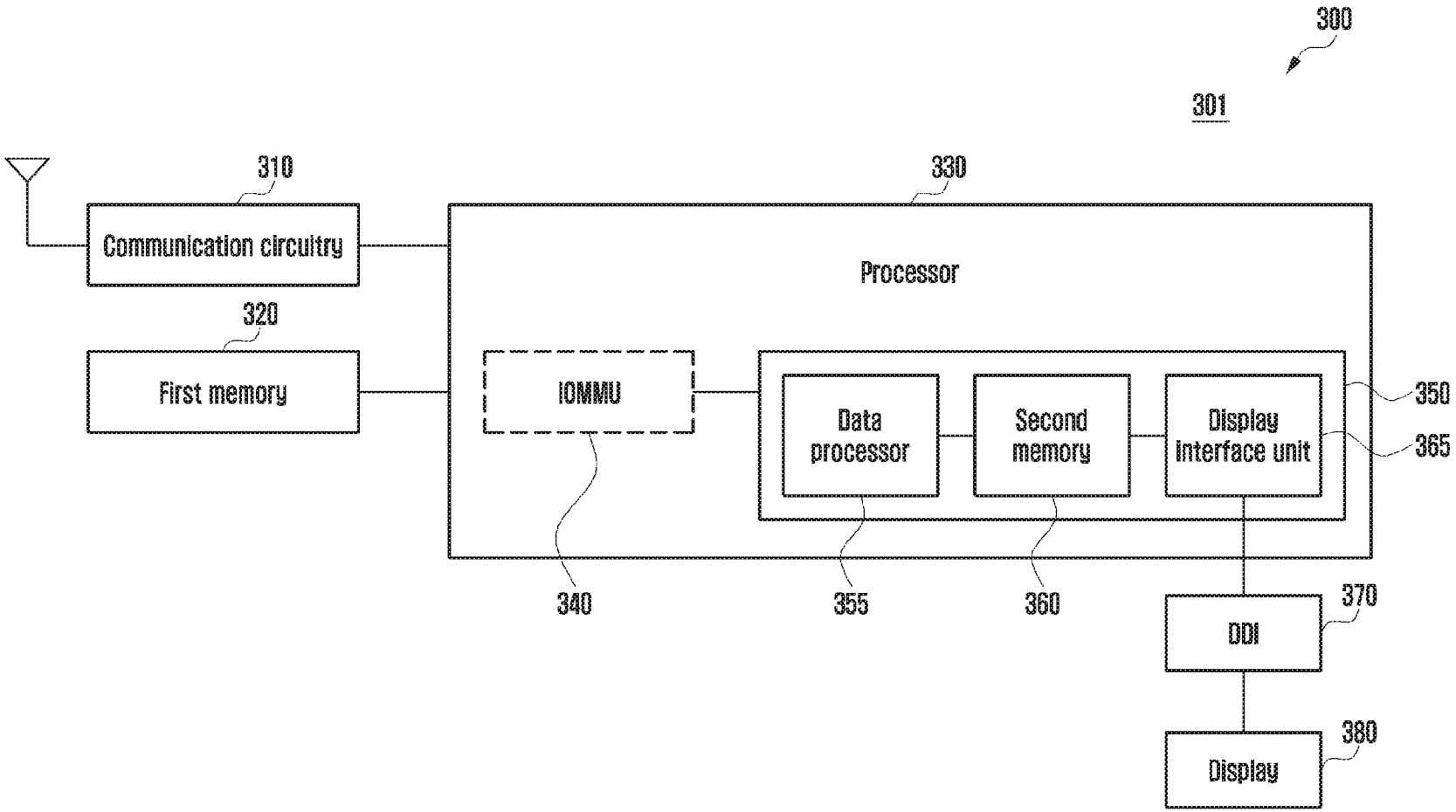
FIG. 3 is a block diagram of an electronic device according to an embodiment.

FIG. 3 is a block diagram 300 of an electronic device 301 according to an embodiment.

Referring to FIG. 3, the electronic device 301 (e.g., the electronic device 101 of FIG. 1) may include a communication circuitry 310 (e.g., the communication module 190 of FIG. 1), a first memory 320 (e.g., the memory 130 of FIG. 1), a processor 330 (e.g., the processor 120 of FIG. 1), a display driver IC (DDI) 370 (e.g., the DDI 230 of FIG. 2), and a display 380 (e.g., the display device 160 of FIG. 1).

The communication circuitry 310 may transmit and receive data to and from an external electronic device connected to the communication circuitry 310 under the control of the processor 330.

The first memory 320 may store a command (or instruction) associated with an operation of an element included in the electronic device 301 or data (e.g., software (e.g., the program 140 of FIG. 1) used by at least one element (e.g., the processor 120), and input data or output data for a related command.

For example, the first memory 320 may store an application program for outputting at least one of text, an image or a GUI object, and may include a volatile memory (e.g., the volatile memory 132 of FIG. 1) or a non-volatile memory (e.g., the non-volatile memory 134 of FIG. 1).

The DDI 370 is electrically connected to the display 380, and may provide the display 380 with an image signal corresponding to image data obtained from the processor 330.

The display 380 may obtain an image signal provided by the DDI 370, may display various types of content, such as text, an image, video, an icon, a widget, or a symbol, based on the image signal, and may include a touch sensor and/or a digitizer panel for recognizing a digital pen. The display 380 and the touch sensor may be configured in an integrated form.

The display 380 may display a plurality of images based on the execution of an application in a single screen form by combining the plurality of images under the control of the processor 330. The display 380 may display the plurality of images, including two images on which update has been performed, in a single screen form when the update of the two images under the control of the processor 330.

The processor 330 may control an overall operation of the electronic device 301 and a signal flow between internal elements of the electronic device 301, may perform data processing, and may control the supply of a battery (e.g., the battery 189 of FIG. 1) to the internal elements.

The processor 330 may include an input/output memory management unit (IOMMU) 340 and a display controller 350, which may include a data processor 355, a second memory 360 (e.g., the memory 233 of FIG. 2), and a display interface unit 365.

The second memory 360 may store image data processed by the data processor 355, and may transmit an image, stored in the second memory 360, to the display 380 physically connected thereto under the control of the display controller 350.

The display controller 350 may combine a plurality of images so that the plurality of images based on the execution of a plurality of applications is displayed on the display 380 in a single screen form. When the update of two images of the plurality of images occurs, the display controller 350 may identify coordinate information of the display area of each of the first image and second image on the screen.

The display controller 350 may identify whether an area not overlapping the coordinate information of the display area of the first image and the display area of the second image is present in the display area of a third image that belongs to the plurality of images and that has not been updated. If no overlap area is present, the display controller 350 may change the coordinate information of the display area of the second image based on the coordinate information of the display area of the first image, and may combine the updated first image and second image based on the coordinate information of the display area of the first image and the changed coordinate information of the display area of the second image. The display controller 350 may store the combined first image and second image in a contiguous address of the second memory 360, and may transmit the coordinate information of each of the display area of the first image and the display area of the second image and the first image and the second image, stored in the second memory 360, to the display 380 through the display interface unit 365.

The coordinate information of the display area of the second image transmitted to the display 380 may include the coordinate information prior to the change. The display 380 may display a plurality of images, including the updated first image and second image, in a single screen form based on the coordinate information of the display area of the first image and the coordinate information of the display area of the second image prior to the change under the control of the processor 330.

When an area overlapping the coordinate information of the display area of the first image and the display area of the second image is present in the display area of the non-updated third image, the display controller 350 may identify whether the area of the display area of the third image overlaps one of the pieces of coordinate information of the display area of the first image and the display area of the second image. When the area of the display area of the third image overlaps one of the pieces of coordinate information of the display area of the first image and the display area of the second image, the display controller 350 may change coordinate information of the display area of the third image, including the area overlapping the coordinate information of the display area of the second image and the coordinate information of the display area of the second image, based on the coordinate information of the display area of the first image. The display controller 350 may store the first image, the second image, and the third image overlapping the coordinate information of the display area of the second image, in a contiguous address of the second memory 360, and may transmit the coordinate information of each of the display area of the first image and the display area of the second image, coordinate information of the display area of the third image overlapping the coordinate information of the display area of the second image, and a third image, including the first image, the second image, and the area overlapping the coordinate information of the display area of the second image stored in the second memory 360, to the display 380 through the display interface unit 365.

When an area overlapping the coordinate information of the display area of the first image and the display area of the second image is present in the display area of the third image, the display controller 350 may change the coordinate information of the display area of the third image including the area overlapping the coordinate information of the display area of the first image, the coordinate information of the second image, and the coordinate information of the display area of the third image including the area overlapping the coordinate information of the second image based on the coordinate information of the display area of the first image. The display controller 350 may store the first image, the second image, and the non-updated third image, including the area overlapping the coordinate information of each of the display area of the first image and the display area of the second image, in a contiguous address of the second memory 360, and may transmit the coordinate information of each of the display area of the first image and the display area of the second image, the coordinate information of the display area of the third image including the area overlapping the coordinate information of each of the display area of the first image and the display area of the second image, and a third image, including the first image, the second image, and the area overlapping the coordinate information of each of the display area of the first image and the display area of the second image stored in the second memory 360, to the display 380 through the display interface unit 365.

When an area overlapping the coordinate information of the display area of the first image and the display area of the second image is present in the display area of the third image, the display controller 350 may remap the display area of the third image, including the area overlapping the coordinate information of the display area of the first image and the display area of the second image, to the IOMMU 340, and may change the coordinate information of the display area of the second image and the coordinate information of the display area of the third image, remapped to the IOMMU 340, based on the coordinate information of the display area of the first image, and may transmit the changed information to the second memory 360. The second memory 360 may store the first image, the second image, and the third image in a contiguous address. The display controller 350 may transmit the coordinate information of each of the display area of the first image and the display area of the second image, the coordinate information of the display area of the third image, and the first image, the second image, and the third image, stored in the second memory 360, to the display 380 through the display interface unit 365.

Figure 4A:
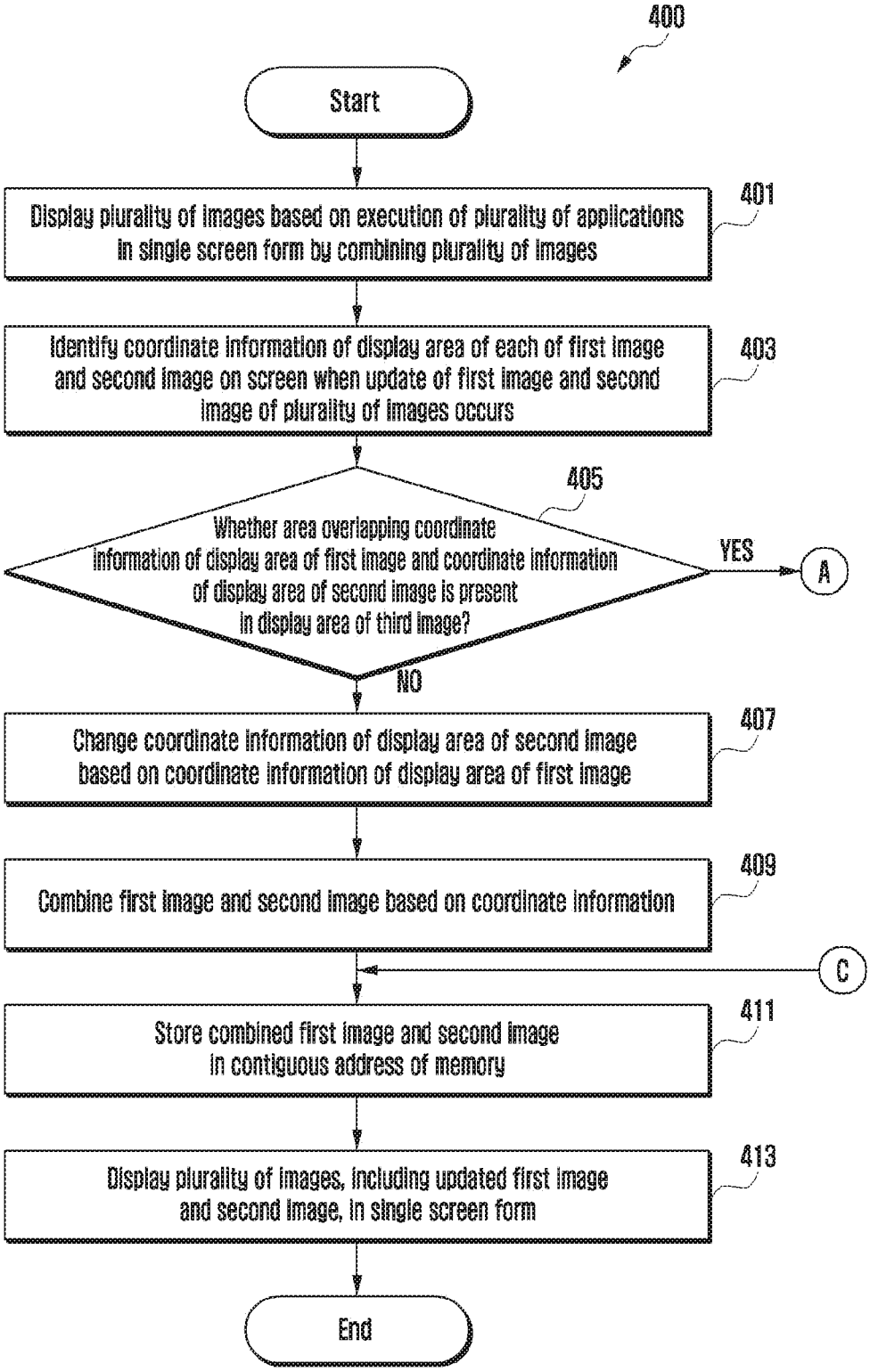
FIG. 4A illustrates a method of partially updating and displaying a screen according to an embodiment.
Figure 4B:
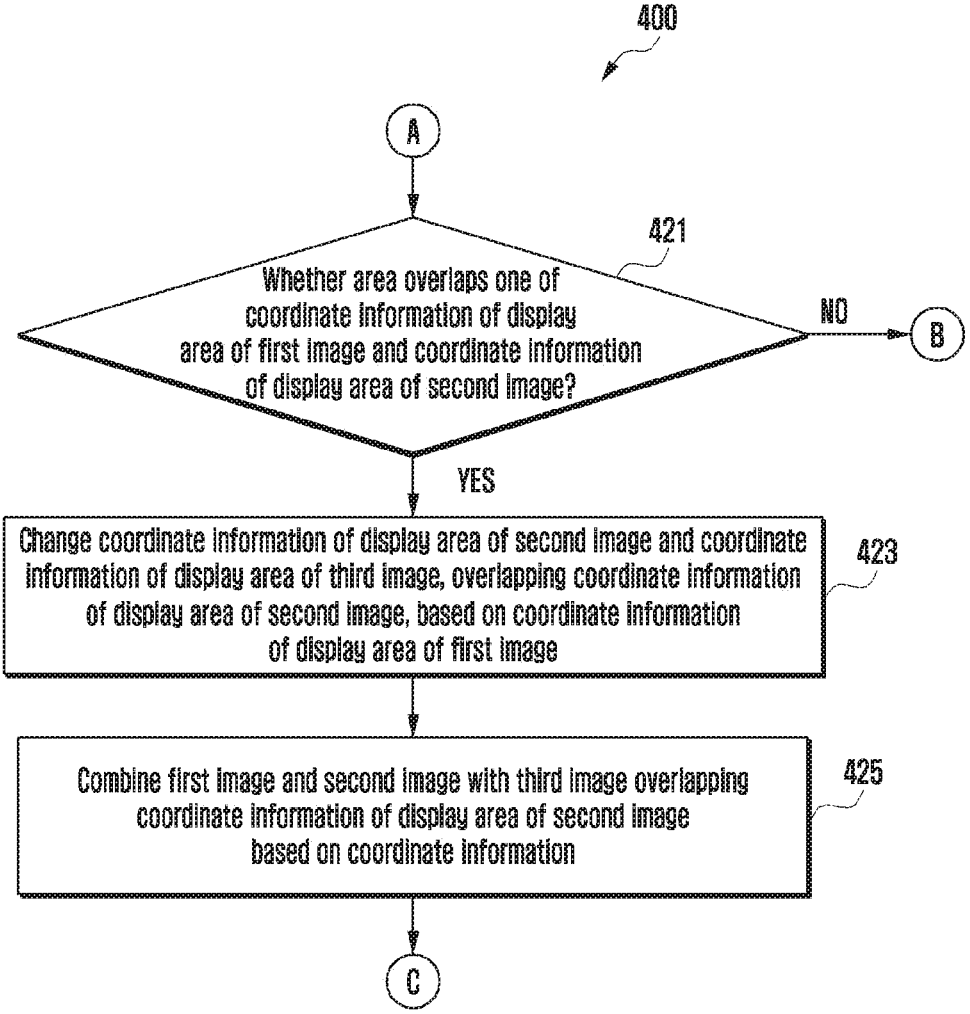
FIG. 4B illustrates a method of partially updating and displaying a screen according to an embodiment.
Figure 4C:
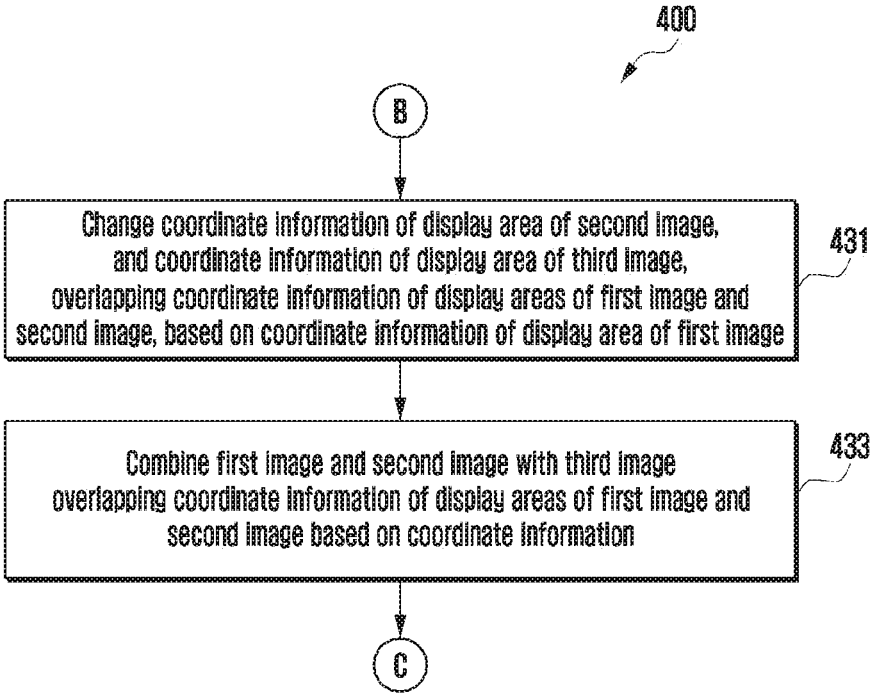
FIG. 4C illustrates a method of partially updating and displaying a screen according to an embodiment.
Figure 4D:
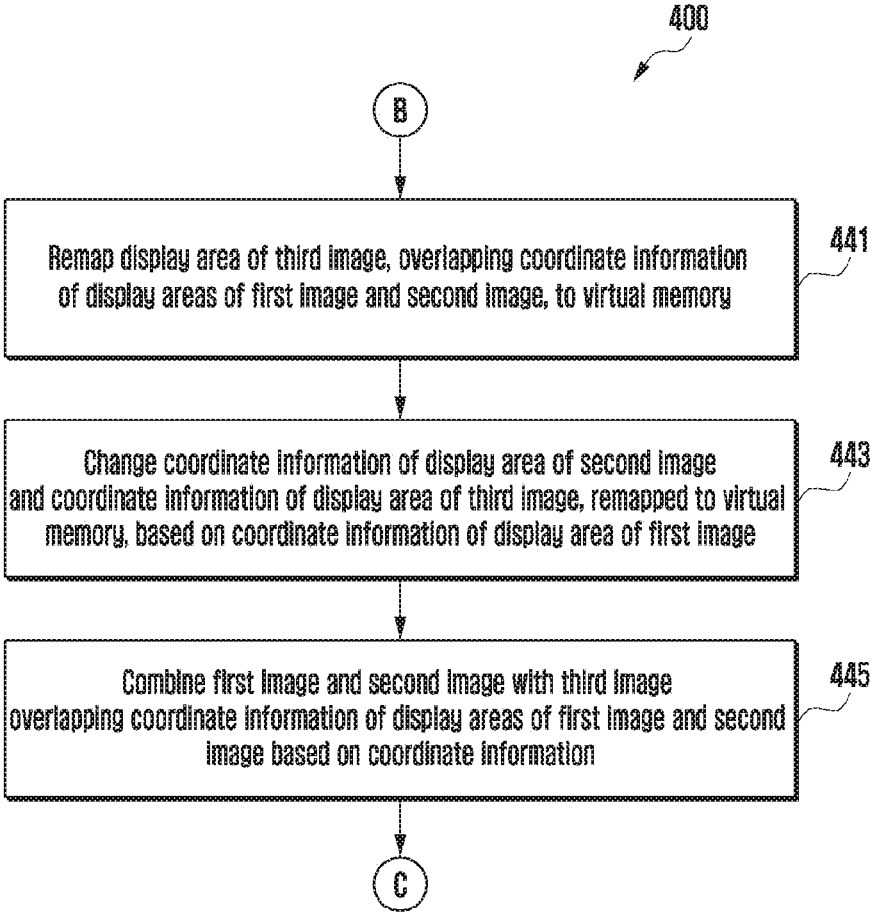
FIG. 4D illustrates a method of partially updating and displaying a screen according to an embodiment.

FIG. 4A illustrates a method of partially updating and displaying a screen according to an embodiment. FIG. 4B illustrates a method of partially updating and displaying a screen according to an embodiment. FIG. 4C illustrates a method of partially updating and displaying a screen according to an embodiment. FIG. 4D illustrates a method of partially updating and displaying a screen according to an embodiment.

Referring to FIG. 4A, in step 401, an electronic device (e.g., the processor 330 of FIG. 3) may display a plurality of images based on the execution of a plurality of applications in a single screen form by combining the plurality of images. For example, execution screen images for the plurality of applications may be displayed in given areas of a display (e.g., the display 380 of FIG. 3). The electronic device (e.g., the processor 330 of FIG. 3) may allocate a given area in which each of the plurality of screen images for the plurality of applications will be displayed. The plurality of images may be displayed in the allocated areas.

For example, the plurality of applications may include an application executed through an application icon and a home screen application (or a launcher application) including an application icon, and may further include at least one of a status bar configured with icons capable of identifying at least one of time, a battery charging state or a communication state, a wallpaper, a menu image in which menu icons are arranged, a navigation bar, and an application screen according to the execution of an application.

Each of the areas in which the plurality of images is displayed may have coordinate information including location information and size information within a screen, such as x, y, width (w), and height (h). For example, the x and y coordinates may indicate the corner coordinates of an image display area positioned within the screen. The width (w) may indicate the width of the image display area. The height (h) may indicate the height of the image display area. The electronic device (e.g., the processor 330 of FIG. 3) may combine the plurality of images based on the coordinate information of each of the areas in which the plurality of images is displayed, and may display the combined images on the display in a single screen form.

Hereinafter, in the embodiments of FIGS. 4A to 4D, it is assumed that updates for the first image and second image of a plurality of images within a single screen occurs and update for the third image of the plurality of images does not occur.

In step 403, when the update of the first image and second image of the plurality of images occurs, the electronic device (e.g., the processor 330 of FIG. 3) may identify coordinate information of the display area of each of the first image and the second image on the screen.

In another embodiment, when update for three or more images of a plurality of images respectively displayed in given areas within a screen, for example, a first image, a second image, and a third image is detected, an electronic device (e.g., the processor 330 of FIG. 3) may identify the distance between the images based on coordinate information, such as the y value of each of the areas in which the first image, the second image, and the third image are displayed within the screen. The electronic device (e.g., the processor 330 of FIG. 3) may configure two images as images to be updated by merging some image display areas of the display areas of the first image, the second image, and the third image based on the identified distance. Embodiments of the disclosure are not limited thereto. For example, when the update of three or more images is detected, an electronic device (e.g., the processor 330 of FIG. 3) may configure three images as images to be updated.

Configuring two images or three images as images to be updated when the update of images exceeding the two images is detected will be described in reference to FIG. 6.

In step 405, the electronic device (e.g., the display controller 350 of FIG. 3) may identify whether an area overlapping the coordinate information of the display area of the first image and the coordinate information of the display area of the second image is present in the display area of a third image.

When an area overlapping the coordinate information of the display area of the first image and the coordinate information of the display area of the second image is present in the display area of the third image (YES), the electronic device (e.g., the data processor 355 of the display controller 350 of FIG. 3) may proceed to the method of FIG. 4B.

When an area overlapping the coordinate information of the display area of the first image and the coordinate information of the display area of the second image is not present in the display area of the third image (NO), in step 407, the electronic device (e.g., the data processor 355 of the display controller 350 of FIG. 3) may change the coordinate information of the display area of the second image based on the coordinate information of the display area of the first image. For example, the electronic device (e.g., the data processor 355 of the display controller 350 of FIG. 3) may change the coordinate information of the display area of the second image so that it is positioned below (or above) the display area of the first image. An operation of changing the coordinate information of the display area of the second image based on the coordinate information of the display area of the first image may be an operation of subsequently storing the first image and the second image in contiguous address spaces of a memory (e.g., the second memory 360 of FIG. 3) within the display controller, for example.

Alternatively, the electronic device (e.g., the data processor 355 of the display controller 350 of FIG. 3) may change the coordinate information of the display area of the second image based on the coordinate information of the display area of the first image.

In step 409, the electronic device (e.g., the display controller 350 of FIG. 3) may combine the updated first image and second image based on the coordinate information of the display area of the first image and the changed coordinate information of the display area of the second image. For example, the electronic device (e.g., the data processor 355 of the display controller 350 of FIG. 3) may combine the first image and the second image so that the display area of the second image having the changed coordinate information is positioned below (or above) the display area of the first image.

In step 411, the electronic device (e.g., the display controller 350 of FIG. 3) may store the combined first image and second image in a contiguous address of a memory (e.g., the second memory 360 of FIG. 3).

In step 413, the electronic device (e.g., the processor 330 of FIG. 3) may display a plurality of images, including the updated first image and second image, on the display (e.g., the display 380 of FIG. 3) in a single screen form by combining the plurality of images. The electronic device (e.g., the display controller 350 of FIG. 3) may transmit the coordinate information of the display area of the first image, the coordinate information of the display area of the second image prior to the change, and the first image and the second image, stored in the contiguous address of the memory, to the display through a display interface unit (e.g., the display interface unit 365 of FIG. 3). The display may display a plurality of images, including the updated first image and second image, in a single screen form based on the coordinate information of the display area of the first image and the coordinate information of the display area of the second image prior to the change obtained through the display interface unit.

Referring to FIG. 4B, when an area overlapping the coordinate information of the display area of the first image and the coordinate information of the display area of the second image is present in the display area of the third image (YES) in step 405 FIG. 4A, in step 421, the electronic device (e.g., the data processor 355 of the display controller 350 of FIG. 3) may identify whether the area of the display area of the third image overlaps one of the coordinate information of the display area of the first image and the coordinate information of the display area of the second image.

When the area of the display area of the third image overlaps one of the coordinate information of the display area of the first image and the coordinate information of the display area of the second image (YES), in step 423, the electronic device (e.g., the data processor 355 of the display controller 350 of FIG. 3) may change the coordinate information of the display area of the second image and coordinate information of the display area of the third image, overlapping the coordinate information of the display area of the second image, based on the coordinate information of the display area of the first image.

For example, a width value of the coordinate information of the display area of the third image prior to the change, such as a "w" value, may be changed to have the same value as a width value (w value) of the display area of the first image. A height value of the coordinate information of the display area of the third image prior to the change, such as an "h" value, may be changed to have the same value as a height value (h value) of the display area of the second image. The electronic device (e.g., the data processor 355 of the display controller 350 of FIG. 3) may change the coordinate information of the display area of the second image, such as the "y" value, so that the display area of the second image is positioned below (or above) the display area of the first image. The electronic device (e.g., the data processor 355 of the display controller 350 of FIG. 3) may change the coordinate information of the display area of the third image (y value) so that the overlapped at least some area of the display area of the third image is positioned below (or above) the display area of the first image.

In step 425, the electronic device (e.g., the data processor 355 of the display controller 350 of FIG. 3) may combine an updated first image and second image with the third image that is displayed in the area overlapping the coordinate information of the display area of the second image and that is not updated, based on coordinate information. For example, the electronic device (e.g., the data processor 355 of the display controller 350 of FIG. 3) may combine the first image and second image with the third image so that the display area of the second image having the changed coordinate information and the display area of the third image overlapping the coordinate information of the display area of the second image are positioned below (or above) the display area of the first image.

After combining the images, the electronic device (e.g., the display controller 350 of FIG. 3) may perform steps 411 and 413 of FIG. 4A.

When an area overlapping one of the coordinate information of the display area of the first image and the coordinate information of the display area of the second image is not present in the display area of the third image (NO) in step 421, the electronic device (e.g., the data processor 355 of the display controller 350 of FIG. 3) may proceed to the method of either FIG. 4C or FIG. 4D.

Referring to FIG. 4C, when an area overlapping one of the coordinate information of the display area of the first image and the coordinate information of the display area of the second image is not present in the display area of the third image (NO) in step 421 of FIG. 4B, when an area overlapping each of the coordinate information of the display area of the first image and the coordinate information of the display area of the second image is present in the display area of the third image, in a first embodiment, in step 431, the electronic device (e.g., the display controller 350 of FIG. 3) may change the coordinate information of the display area of the second image, and coordinate information of the display area of the third image, overlapping each of the coordinate information of the display area of the first image and the coordinate information of the display area of the second image, based on the coordinate information of the display area of the first image.

In step 433, the electronic device (e.g., the display controller 350 of FIG. 3) may combine an updated first image and second image with a third image that overlaps coordinate information of the display areas of the first image and the second image and that is not updated, based on coordinate information. For example, the electronic device (e.g., the data processor 355 of the display controller 350 of FIG. 3) may combine a first image and second image with a third image so that the display area of the second image and a display area of the third image overlapping coordinate information of the display area of the second image are consecutive to the display area of the first image and the display area of the third image overlapping coordinate information of the display area of the first image are positioned below the display area of the first image and the display area of the third image.

After the first image, the second image, and the third image overlapping the coordinate information of the display area of the first image and the coordinate information of the display area of the second image are combined, the electronic device (e.g., the display controller 350 of FIG. 3) may perform steps 411 and 413 of FIG. 4A.

Referring to FIG. 4D, when an area overlapping one of the coordinate information of the display area of the first image and the coordinate information of the display area of the second image is not present in the display area of the third image (NO) in step 421 of FIG. 4B, when an area overlapping each of the coordinate information of the display area of the first image and the coordinate information of the display area of the second image is present in the image display area, in a second embodiment, in step 441, the electronic device (e.g., the processor 330 of FIG. 3) may remap the display area of the third image, overlapping each of the coordinate information of the display area of the first image and the coordinate information of the display area of the second image, to a virtual memory (e.g., the IOMMU 340 of FIG. 3). For example, the electronic device (e.g., the processor 330 of FIG. 3) may remap a virtual address of coordinate information for the first area of the display area of the third image, overlapping the coordinate information of the display area of the first image, and a virtual address of coordinate information for the second area of the display area of the third image, overlapping the coordinate information of the display area of the second image, so that the virtual addresses are connected within the virtual memory.

In step 443, the electronic device (e.g., the data processor 355 of the display controller 350 of FIG. 3) may change the coordinate information of the display area of the second image and the coordinate information of the display area of the third image, remapped to the virtual memory, based on the coordinate information of the display area of the first image. For example, the electronic device (e.g., the data processor 355 of the display controller 350 of FIG. 3) may reconfigure a virtual address and coordinate information for the display area of the third image, which are remapped within the virtual memory and at least overlapped.

In step 445, the electronic device (e.g., the data processor 355 of the display controller 350 of FIG. 3) may combine an updated first image and second image with a third image that is displayed in an area overlapping coordinate information of the display area of the first image and coordinate information of the display area of the second image and that is not updated, based on coordinate information.

After combining the updated first image and second image with the third image that is displayed in the area overlapping the coordinate information of the display area of the first image and the coordinate information of the display area of the second image and that is not updated, the electronic device (e.g., the display controller 350 of FIG. 3) may perform steps 411 and 413 of FIG. 4A.

Figure 5:
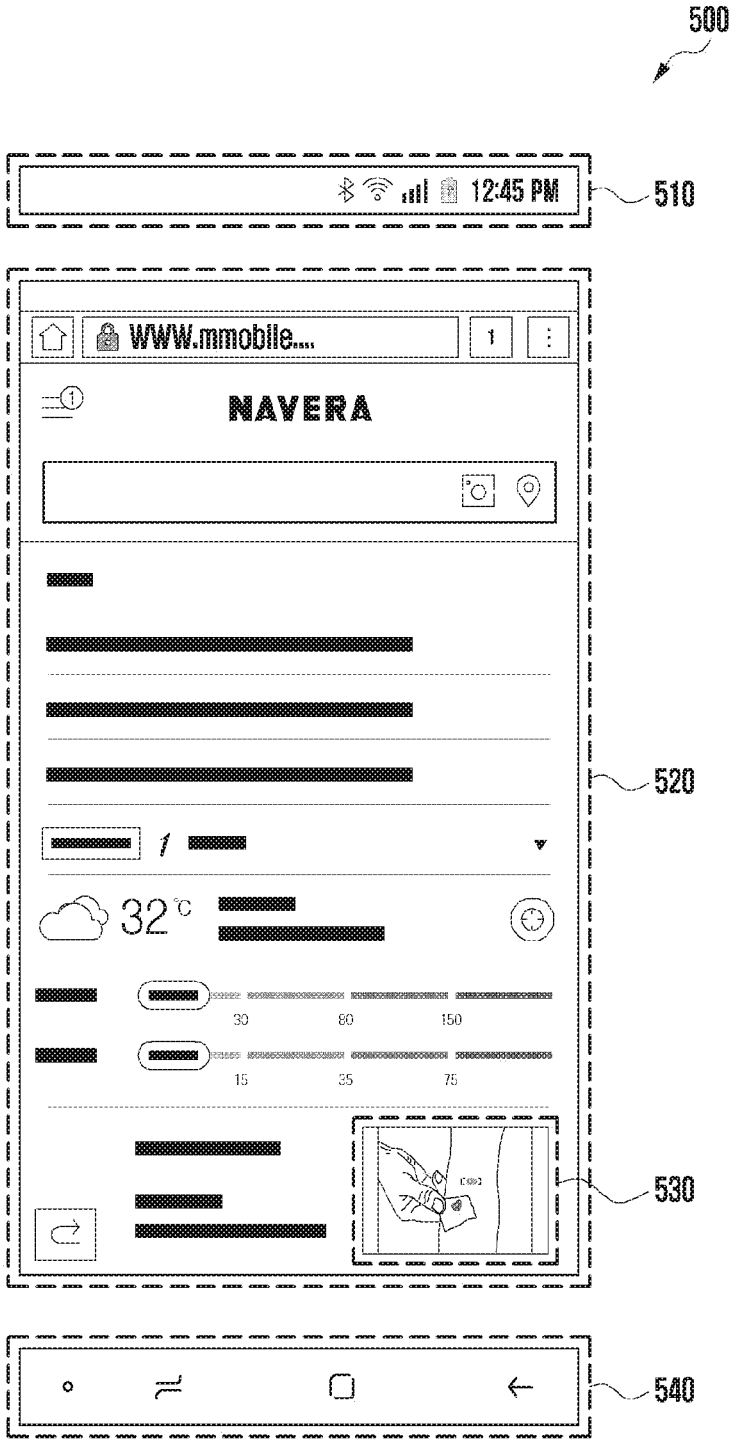
FIG. 5 illustrates a screen configured with a plurality of images associated with a plurality of applications according to an embodiment.

FIG. 5 illustrates a screen configured with a plurality of images associated with a plurality of applications according to an embodiment.

Referring to FIG. 5, a processor (e.g., the processor 350 of FIG. 3) may display a plurality of images based on the execution of a plurality of applications on a display (e.g., the display 380 of FIG. 3) in a single screen form by combining the plurality of images. For example, the plurality of images for the plurality of applications may be displayed in given areas of a display (e.g., the display 380 of FIG. 3). An electronic device (e.g., the processor 330 of FIG. 3) may allocate a given area in which each of the plurality of images for the plurality of applications will be displayed. The plurality of images may be displayed in the allocated given areas.

In FIG. 5, It is assumed that a status bar display area displayed in a given area within a screen is a first image 510, a web browser display area is a second image 520, a popup player display area is a third image 530, and a navigation bar display area is a fourth image 540.

Each of the display areas of the first to the fourth images 510, 520, 530, and 540 may have coordinate information including location information and size information within a screen, such as x, y, width (w), and height (h). For example, the x and y coordinates may indicate corner coordinates of an image display area positioned within the screen, the width (w) may indicate the width of the image display area, and the height (h) may indicate the height of the image display area.

For example, the coordinate information of the display area of the first image 510 displayed in the given area within the screen may be (0, 0, 1440, 84), the coordinate information of the display area of the second image 520 displayed therein may be (0, 84, 1440, 2708), the coordinate information of the display area of the third image 530 displayed therein may be (616, 2200, 640, 400), and the coordinate information of the display area of the fourth image 540 displayed therein may be (0, 2792, 1440, 168). A processor (e.g., the processor 350 of FIG. 3) may display the first to the fourth images 510, 520, 530, and 540 on a display (e.g., the display 380 of FIG. 3) in a single screen form by combining the first image to the fourth image based on the coordinate information of the display areas of the first to the fourth images 510, 520, 530, and 540.

When the update of two images of the first the fourth images 510, 520, 530, and 540, such as the first image 510 and the third image 530 is detected, the first image 510 and the third image 530 may be updated using different methods based on whether there is an image that overlaps the coordinate information of at least one of the display areas of the first image 510 and the third image 530 and that is not updated. This is described with reference to FIGS. 7 to 10.

Figure 6:
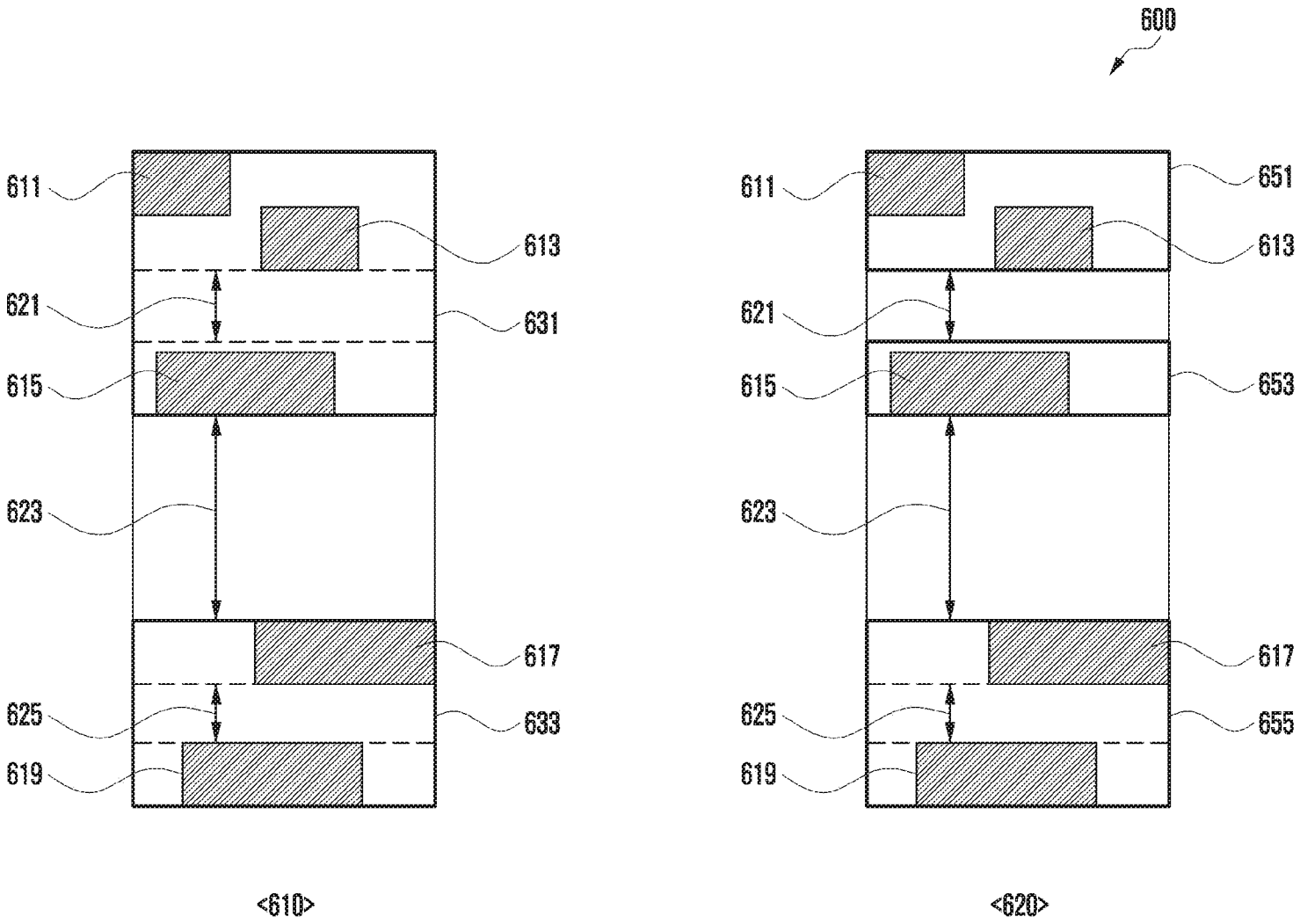
FIG. 6 illustrates a method of configuring an image when a plurality of images is updated according to an embodiment.

FIG. 6 illustrates a method of configuring an image when a plurality of images is updated according to an embodiment.

Referring to FIG. 6, when the update of three or more images is detected, an electronic device may configure two images as images to be updated by merging at least some area of the display areas of the three or more images.

For example, as shown in screenshot 610, the electronic device may display a plurality of images associated with a first image 611, a second image 613, a third image 615, a fourth image 617, and a fifth image 619 in given areas within a screen. In an embodiment, when the update of the first image 611, the second image 613, the third image 615, the fourth image 617, and the fifth image 619 displayed in the given area within the screen is detected, the electronic device may identify the y-axis interval between the display areas of the images based on coordinate information, such as the y value of the display area of each image.

It is assumed that the distance between the display area of the second image 613 and the display area of the third image 615 is a first distance 621, the distance between the display area of the third image 615 and the display area of the fourth image 617 is a second distance 623, and the distance between the display area of the fourth image 617 and the display area of the fifth image 619 is a third distance 625, and the lengths of the second distance 623, the first distance 621, and the third distance 625 are long in this sequence.

The processor may configure two images as images to be updated by merging at least some area of the display areas of the first image to the fifth images 611, 613, 615, 617, and 619 by merging based on the distance. For example, the processor may configure the display area of the first image 611, the display area of the second image 613, and the display area of the third image 615 as a first image 631 by merging the display areas above the second distance 623 having the longest length so that they are included in the first image 631, and may configure the display area of the fourth image 617 and the display area of the fifth image 619 as a second image 633 by merging the display areas below the second distance 623 so that they are included in the second image 633.

It has been assumed that a plurality of the images 611, 613, 615, 617, and 619 is updated by configuring the display areas of the images as the two images 631 and 633, but the disclosure is not limited thereto. Three images may be configured as images to be updated. For example, as shown in screenshot 620, the processor may configure the display area of the first image 611 and the display area of the second image 613 as a first image 651 by merging the display areas so that they are included in the first image 651, may configure the display area of the third image 615 as a second image 653, and may configure the display areas of the fourth image 617 and the fifth image 619 as a third image 655 by merging the display areas so that they are included in the third image 655, based on the second distance 623 and the first distance 621.

When a plurality of the images 611, 613, 615, 617, and 619 is updated, the display areas of the plurality of images 611, 613, 615, 617, and 619 are configured as a given number of images, such as the two images 631 and 633, or the three images 651, 653, and 655), by merging some of the display areas based on the interval between the display areas of the images. Current consumed as images configured as a given number are updated can be reduced more than current consumed as each of a plurality of images is updated, since the use of memory necessary for the update can be reduced.

Figure 7:
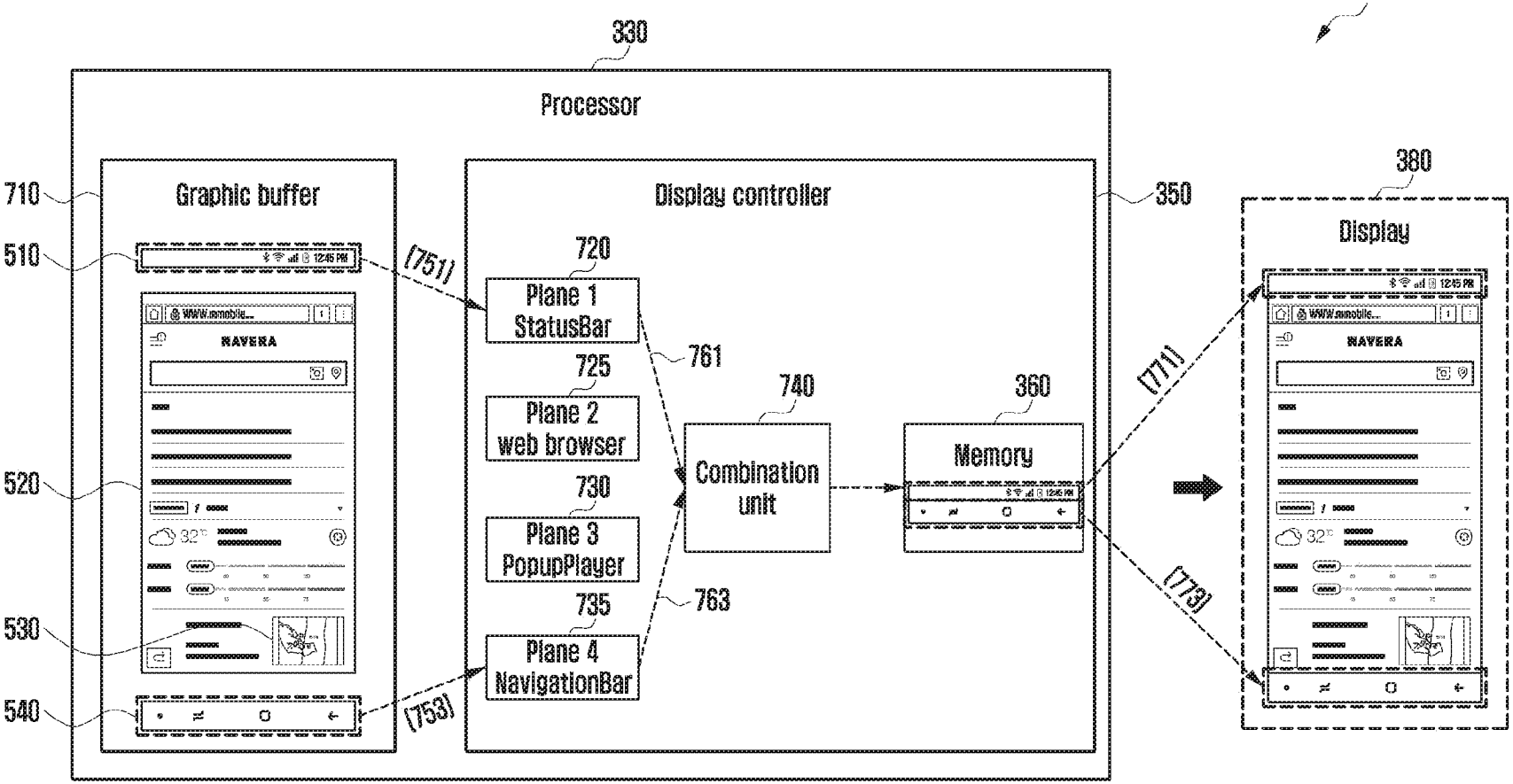
FIG. 7 illustrates a method of partially updating and displaying a screen according to an embodiment.

FIG. 7 illustrates a method of partially updating and displaying a screen according to an embodiment.

In FIG. 7, a first image 510 and a fourth image 540 are updated, and the display areas of the updated first image 510 and fourth image 540 do not overlap the display areas of a second image 520 and third image 530 that have not been updated.

Referring to FIG. 7, the processor 330 may display execution screen images for a plurality of applications in given areas within a screen of the display 380, and may allocate a given area in which each of a plurality of the screen images for the plurality of applications will be displayed. The plurality of images may be displayed in the allocated areas. In an embodiment, the plurality of images displayed in the allocated areas may be displayed at least in an overlap manner. For example, the processor 330 may display a plurality of images, such as a first image 510, such as a status bar, a second image 520, such as a web browser, a third image 530, such as a popup player, and a fourth image 540, such as a navigation bar, in given areas within a screen. The third image 530 may overlap the second image 520 when it is displayed in the given area.

The display controller 350 may render the first to the fourth images 510, 520, 530, and 540, displayed in the given areas within the screen, to a graphic buffer 710.

Each of a first plane unit to a fourth plane unit 720, 725, 730, and 735 may include first coordinate information and second coordinate information of each of the display areas of the first to the fourth images 510, 520, 530, and 540. The first coordinate information may include source coordinate information, and the second coordinate information may include destination coordinate information. The first coordinate information may be used to configure coordinate information of the display area of an image to be read by a plane unit. The second coordinate information may be used to write combined images, obtained by combing the images related to update, in the memory 360.

The display controller 350 may allocate coordinate information (e.g., first coordinate information) of the display areas of the first to the fourth images 510, 520, 530, and 540 to the plane units, respectively. For example, the display controller 350 may allocate coordinate information of the display area of the first image 510 to the first plane unit (Plane1) 720, may allocate coordinate information of the display area of the second image 520 to the second plane unit (Plane2) 725, may allocate coordinate information of the display area of the third image 530 to the third plane unit (Plane3) 730, and may allocate coordinate information of the display area of the fourth image 540 to the fourth plane unit (Plane4) 735.

The display controller 350 may detect the update of the first image 510 and the fourth image 540 displayed in given areas within a screen. As shown in FIG. 7, when the display areas of the updated first image 510 and fourth image 540 do not overlap the display areas of the second image 520 and third image 530 that have not been updated, plane units, such as the first plane unit 720 and the fourth plane unit 735, to which coordinate information of the display areas of the updated first image 510 and the fourth image 540 have been allocated may read the pixel data of the display areas of the first image 510 and fourth image 540 rendered to the graphic buffer 710 through direct memory access (DMA). For example, plane units of the display controller 350, such as the first plane unit 720, may read 751 the pixel data of the display area of the first image 510 (e.g., status bar). The fourth plane unit 735 may read (753) the pixel data of the display area of the fourth image 540 (e.g., navigation bar).

The display controller 350 may change the coordinate information (e.g., second coordinate information) of the display area of the fourth image 540 based on the coordinate information of the display area of the first image 510, from among the display areas of the updated first image 510 and fourth image 540. For example, assuming that coordinate information of the display area of the first image 510 is (0, 0, 1440, 84) and coordinate information of the display area of the fourth image 540 is (0, 2792, 1440, 168), the display controller 350 may change the coordinate information (e.g., second coordinate information) (0, 2792, 1440, 168) of the display area of the fourth image 540 into (0, 84, 1440, 168) based on the coordinate information (0, 0, 1440, 84) of the display area of the first image 510.

In FIG. 7, it has been described that the coordinate information of the display area of the fourth image 540 is changed based on the coordinate information of the display area of the first image 510, but the disclosure is not limited thereto. For example, the display controller 350 may change the coordinate information (e.g., second coordinate information) (0, 0, 1440, 84) of the display area of the first image 510 into (0, 2708, 1440, 168) based on the coordinate information (0, 2792, 1440, 168) of the display area of the fourth image 540.

The first plane unit 720 and the fourth plane unit 735, to which updated images of the display controller 350, i.e., the coordinate information of the display area of the first image 510 and the coordinate information of the display area of the fourth image 540, have been allocated may transmit (761, 763) changed coordinate information of the display areas of the first image 510 and the fourth image 540 to the combination unit 740. A combination unit 740 may combine the first image 510 and the fourth image 540 based on the changed coordinate information (e.g., (0, 0, 1440, 84)) of the display area of the first image 510 and the changed coordinate information (e.g., (0, 84, 1440, 168)) of the display area of the fourth image 540. For example, when the y value of the coordinate information of the display area of the fourth image 540 is changed from 2792 to 84, the combination unit 740 may combine the first image 510 and the fourth image 540 so that the display area of the fourth image 540 is positioned below the display area of the first image 510.

The display controller 350 may store the first image 510 and the fourth image 540, combined by the combination unit 740, in the memory 360 (e.g., the second memory 360 of FIG. 3), such as in a contiguous address of a first in first out (FIFO) memory.

The display controller 350 may transmit (771, 773) the coordinate information (e.g., (0, 84, 1440, 168)) of the display area of the first image 510 stored in the memory 360, the pixel data of the display area of the first image 510, the coordinate information (e.g., (0, 2792, 1440, 168)) of the display area of the fourth image 540 prior to the change, and the pixel data of the display area of the fourth image 540 to the display 380 through a display interface (e.g., the display interface unit 365 of FIG. 3), such as mobile industry processor interface (MIPI), a display port (DP). The display 380 may display a plurality of images including the updated first image 510 and fourth image 540 (e.g., the updated first image 510, the not-updated second image 520 and third image 530, and the updated fourth image 540) in a single screen form by combining the plurality of images based on the coordinate information of the display area of the first image 510 and the coordinate information of the display area of the fourth image 540 prior to the changed, which have been obtained from the display controller 350 through the display interface unit 365. For example, the processor 330 may display, on the display 380, a single screen in which the second image 520 and third image 530 whose coordinate information has not been changed are maintained and only the first image 510 and the fourth image 540 have been updated.

In FIG. 7, it has been assumed that two images are updated, but the disclosure is not limited thereto. For example, if three images have been updated, such as if the areas in which two images are displayed are updated, the display controller 350 may change coordinate information of areas in which two updated images are displayed based on the area in which one updated image is displayed, and may store the changed coordinate information in a contiguous address space of the memory 360. The display controller 350 may transmit, to the display 380, coordinate information of the display area of one updated image stored in the memory 360, coordinate information of the display areas of two updated images prior to the change, and the pixel data of the display areas of the three updated images. The display 380 may display a screen, including the three updated images, based on the coordinate information of the display areas of the three updated images and the pixel data of the imaged.

Figure 8:
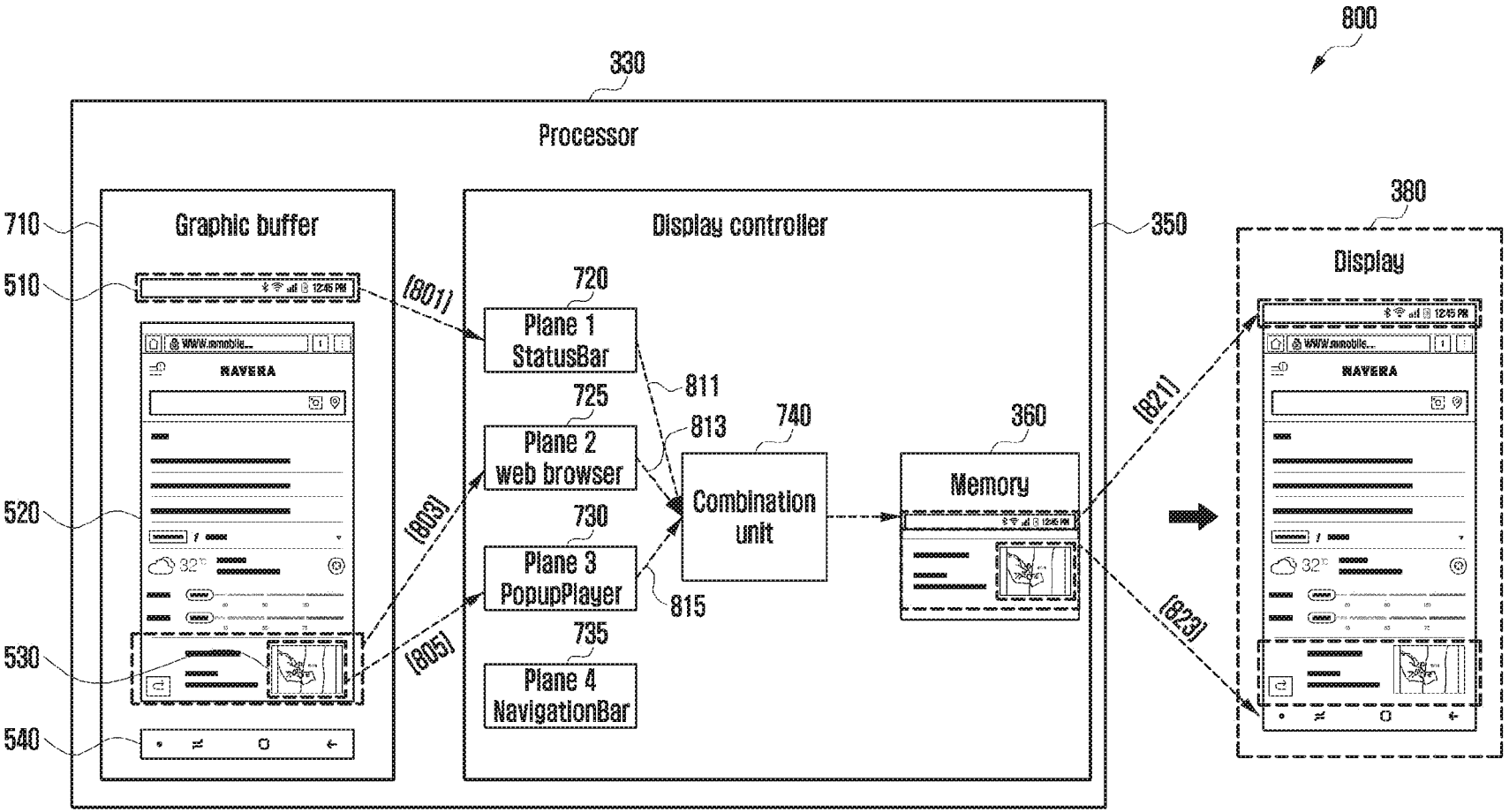
FIG. 8 illustrates a method of partially updating and displaying a screen according to an embodiment.

FIG. 8 is a diagram 800 illustrating a method of partially updating and displaying a screen according to an embodiment.

FIG. 8 illustrates when a first image 510 and a third image 530 have been updated and the display area of a not-update second image 520 overlaps coordinate information of the display area of the updated third image 530.

Referring to FIG. 8, the processor 330 may display execution screen images for a plurality of applications in given areas within a screen of the display 380, and may allocate a given area in which each of the plurality of screen images for the plurality of applications will be displayed. The plurality of images may be displayed in the allocated areas, in an overlapping manner. For example, a plurality of images, for example, a first image 510 (e.g., status bar), a second image 520 (e.g., web browser), a third image 530 (e.g., popup player), and a fourth image 540 (e.g., navigation bar) may be displayed in given areas within a screen. The third image 530 may overlap the second image 520 when it is displayed in the given area.

The display controller 350 may render the first to the fourth images 510, 520, 530, and 540, displayed in the given areas within the screen, to a graphic buffer 710.

Each of a first plane unit to a fourth plane unit 720, 725, 730, and 735 may include first coordinate information and second coordinate information of each of the display areas of the first to the fourth images 510, 520, 530, and 540. The first coordinate information may include source coordinate information, and the second coordinate information may include destination coordinate information. The first coordinate information may be used to configure coordinate information of the display area of an image to be read by a plane unit. The second coordinate information may be used to write combined images, obtained by combining the images related to update, in the memory 360.

The display controller 350 may allocate coordinate information (e.g., first coordinate information) of each of the display areas of the first to the fourth images 510, 520, 530, and 540 to the plane units, respectively. For example, the display controller 350 may allocate coordinate information of the display area of the first image 510 to the first plane unit (Plane1) 720, may allocate coordinate information of the display area of the second image 520 to the second plane unit (Plane2) 725, may allocate coordinate information of the display area of the third image 530 to the third plane unit (Plane3) 730, and may allocate coordinate information of the display area of the fourth image 540 to the fourth plane unit (Plane4) 735.

When the coordinate information of the display area of the third image 530 overlaps the display area of the second image 520, the coordinate information of the display area of the second image 520 allocated to the second plane unit (Plane2) 725 may be coordinate information including the coordinate information of the display area of the third image 530. The display controller 350 may detect the update of the first image 510 and the third image 530 displayed in given areas within a screen.

As shown in FIG. 8, when the coordinate information of the display area of the not-update second image 520 and the coordinate information of the display area of the updated third image 530 overlap, the plane unit associated with the updated image may read the pixel data of the areas in which images associated with update are displayed through DMA. The first plane unit 720 may read (801) the pixel data of the display area of the first image 510 (e.g., status bar). The second plane unit 725 may read (803) the pixel data of the display area of the second image 520 (e.g., web browser) overlapping the coordinate information of the display area of the third image 530. The third plane unit 730 may read (805) the pixel data of the display area of the third image 530 (e.g., popup player).

The display controller 350 may change coordinate information (e.g., second coordinate information) of the display area of the third image 530 and coordinate information (e.g., second coordinate information) of the display area of the second image 520 overlapping the coordinate information of the display area of the third image 530, based on the coordinate information of the display area of the updated first image 510.

For example, it is assumed that the coordinate information of the display area of the first image 510 is (0, 0, 1440, 84), the coordinate information of the display area of the third image 530 is (616, 2200, 640, 400), and coordinate information of the display area of the second image 520 including an area overlapping the coordinate information of the display area of the third image 530 is (0, 2200, 1440, 400). The coordinate information (0, 2200, 1440, 400) that belongs to the display area of the second image 520 and that overlaps the coordinate information of the display area of the third image 530 includes the coordinate information of the display area of the third image 530, and may include coordinate information having 1440, such as width value of resolution defined in the display 380 or the width value of the first image 510, as a width value (w value) and 400 i.e., the same value as the height value (h value) of the third image 530 as a height value (h value), for example. The display controller 350 may change the coordinate information of the display area of the third image 530 from (616, 2200, 640, 400) to (616, 84, 640, 400) and change the coordinate information of the display area of the second image 520 from (0, 2200, 1440, 400) to (0, 84, 1440, 400), based on the coordinate information (0, 0, 1440, 84) of the display area of the first image 510.

An erroneous combination with the first image 510 based on a change in only the coordinate information of the display area of the third image 530 can be prevented because coordinate information of the display area of the second image 520 overlapping coordinate information of the display area of the third image 530 is also changed in addition to coordinate information of the display area of the third image 530.

In FIG. 8, coordinate information of the display area of the third image 530 and coordinate information of the display area of the second image 520 overlapping the coordinate information of the display area of the third image 530 are changed based on coordinate information of the display area of the first image 510, but the disclosure is not limited thereto. For example, the display controller 350 may change coordinate information of the display area of the first image 510 into (0, 2116, 1440, 168) based on the coordinate information (0, 2200, 1440, 400) of the display area of the second image 520 overlapping the coordinate information of the display area of the third image 530.

The first plane unit 720, the second plane unit 725, and the third plane unit 730 of the display controller 350 to which coordinate information of the display area of an updated image has been allocated may transmit (811, 813, 815) the coordinate information of the display area of the first image 510, the changed coordinate information of the display area of the second image 520, and the changed coordinate information of the display area of the third image 530 to a combination unit 740. The combination unit 740 may combine the first image 510, the second image 520, and the third image 530 based on the coordinate information (e.g., (0, 0, 1440, 84)) of the display area of the first image 510, the changed coordinate information (e.g., (0, 84, 1440, 400)) of the display area of the second image 520, and the changed coordinate information (e.g., (616, 84, 640, 400) of the display area of the third image 530. For example, when a y value of the coordinate information of the display area of the second image 520 and a y value of the coordinate information of the display area of the third image 530 are changed from 2200 to 84, the combination unit 740 may combine the first image 510, the second image 520, and the third image 530 so that the display area of the second image 520 and the display area of the third image 530 are positioned below the display area of the first image 510.

The display controller 350 may store the first image 510, the second image 520, and the third image 530, combined by the combination unit 740, in a contiguous address of the memory 360 (e.g., the second memory 360 of FIG. 3), for example, a FIFO memory.

The display controller 350 may transmit (821, 823) (0, 84, 1440, 168), i.e., the coordinate information of the display area of the first image 510, the pixel data of the display area of the first image 510, (0, 2200, 1440, 400), i.e., the coordinate information of the display area of the second image 520 prior to the change, the pixel data of the display area of the second image 520, (616, 2200, 640, 400), i.e., the coordinate information of the display area of the third image 530 prior to the change, and the pixel data of the display area of the third image 530 to the display 380 through a display interface (e.g., the display interface unit 365 of FIG. 3). The display 380 may display a plurality of images, including the updated first image 510 and third image 530, in a single screen form based on the coordinate information of the display area of the first image 510, the coordinate information of the display area of the second image 520 prior to the change, and the coordinate information of the display area of the third image 530 prior to the change, which have been obtained from the display controller 350 through the display interface unit 365.

In FIG. 8, it has been assumed that two images are updated, but the disclosure is not limited thereto. For example, when the first image 510, the third image 530, and the fourth image 540 have been updated, the display controller 350 may change coordinate information of the display area of the fourth image 540 based on coordinate information of the display area of the first image 510 so that the areas in which updated images are displayed are stored in a contiguous address of the memory 360, in addition to the operation if two images have been updated.

The display controller 350 may transmit the coordinate information of the display area of the first image 510, the coordinate information of the display area of the second image 520 prior to the change, the coordinate information of the display area of the third image 530 prior to the change, the coordinate information of the display area of the fourth image 540 prior to the change, stored in the memory 360, and the pixel data of the display areas of the first image 510, the second image 520, the third image 530, and the fourth image 540 to the display 380. The display 380 may display a plurality of images, including the updated three images, in a single screen form based on the coordinate information and pixel data of the images obtained from the display controller 350.

Figure 9:
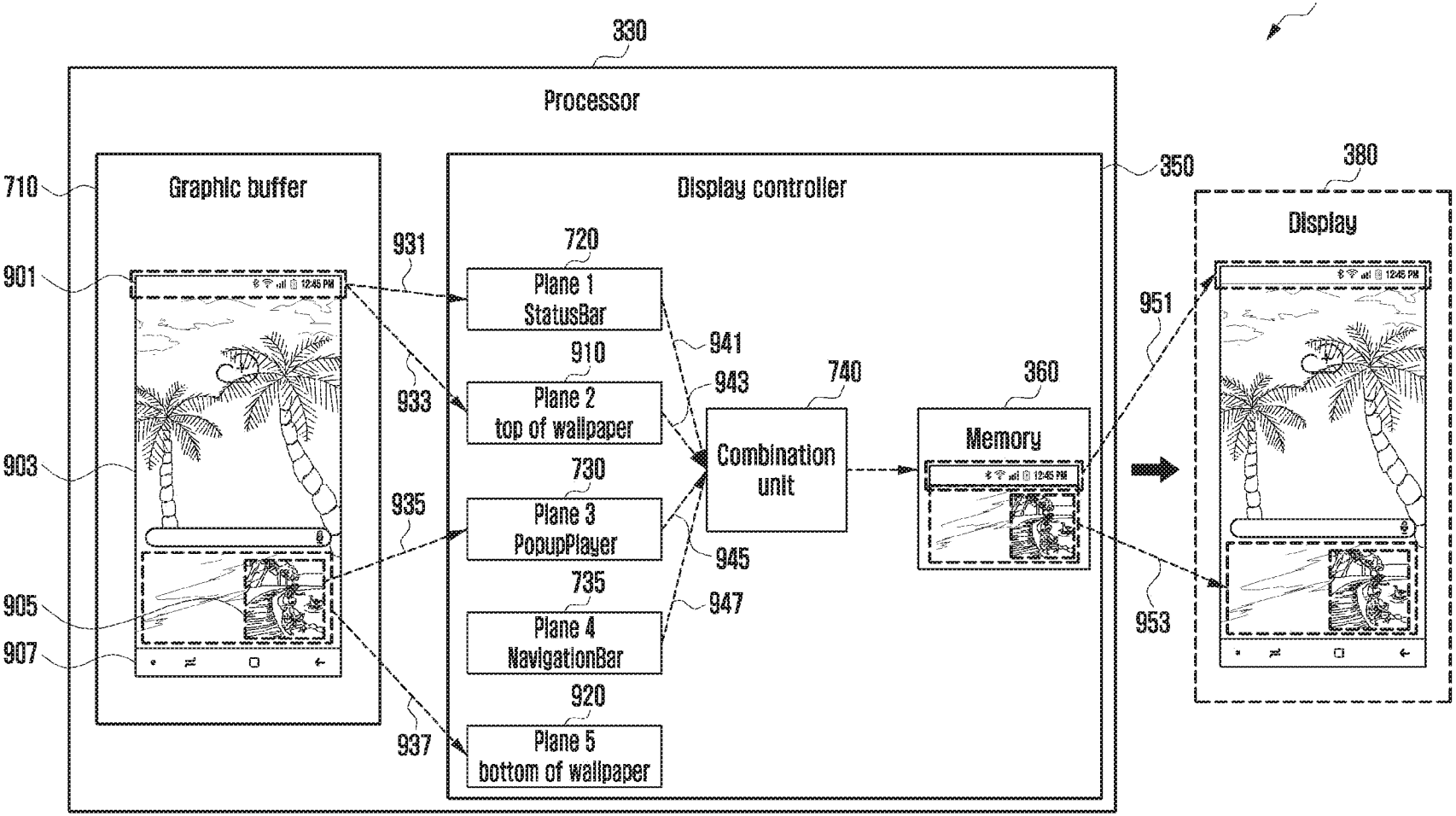
FIG. 9 illustrates a method of partially updating and displaying a screen according to an embodiment.

FIG. 9 illustrates a method of partially updating and displaying a screen according to an embodiment.

FIG. 9 illustrates when a first image 901 and a third image 905 have been updated and the display area of a second image 903 that has not been updated overlaps coordinate information of the display area of the updated first image 901 and coordinate information of the display area of the updated third image 905.

Referring to FIG. 9, the processor 330 may display execution screen images for a plurality of applications in given areas within a screen of the display 380, and may allocate a given area in which each of the plurality of screen images for the plurality of applications will be displayed. The plurality of images may be displayed in the allocated areas. In an embodiment, the plurality of images displayed in the allocated areas may be displayed in an overlap manner. For example, a plurality of images, for example, a first image 901, such as a status bar, a second image 903, such as wallpaper, a third image 905, such as a popup player, and a fourth image 907, such as a navigation bar, may be displayed in given areas within a screen. The first image 901 and the third image 905 may overlap the second image 903 when they are displayed in the given areas.

The display controller 350 may render the first image to the fourth image 901, 903, 905, and 907, displayed in given areas within a screen, to a graphic buffer 710.

Each of a first plane unit to a fifth plane unit 720, 910, 730, 735, and 920 may include first coordinate information and second coordinate information of each of the display areas of the images 901, 903, 905, and 907. The first coordinate information may include source coordinate information, and the second coordinate information may include destination coordinate information.

The first coordinate information may be used to configure coordinate information of the display area of an image to be read by a plane unit. The second coordinate information may be used to write combined images, obtained by combining the images related to update, in the memory 360.

The display controller 350 may allocate coordinate information of the display areas of the first image to the fourth image 901, 903, 905, and 907 to the plane units, respectively. For example, the display controller 350 may allocate coordinate information of the display area of the first image 901 to the first plane unit 720, may allocate coordinate information of the first area, such as a top area of the display area of the second image 903, overlapping the coordinate information of the display area of the first image 901, to the second plane unit 910, may allocate coordinate information of the display area of the third image 905 to the third plane unit 730, may allocate coordinate information of the display area of the fourth image 907 to the fourth plane unit 735, and may allocate coordinate information of the second area, such as a bottom area of the display area of the second image 903, overlapping the coordinate information of the display area of the third image 905, to the fifth plane unit 920.

The display controller 350 may allocate coordinate information of the first area and the second area of the display area of the second image 903, respectively overlapping coordinate information of the display area of the first image 901 and coordinate information of the display area of the third image 905, to the second plane unit 910 and the fifth plane unit 920. For example, assuming that coordinate information of the display area of the second image 903, i.e., first coordinate information and second coordinate information, are (0, 0, 1440, 2960), the display controller 350 may configure first coordinate information of the display area of the second image 903, overlapping the coordinate information of the display area of the first image 901, as (0, 0, 1440, 84), for example, and may allocate (0, 0, 1440, 84) to the second plane unit 910. The display controller 350 may configure the coordinate information (0, 0, 1440, 2960) of the display area of the second image 903 as coordinate information of the display area of the third image 905 and first coordinate information of the display area of the second image 903, for example, (0, 2200, 1440, 400), and may allocate (0, 2200, 1440, 400) to the fifth plane unit 920.

The display controller 350 may detect the update of the first image 901 and the third image 905 displayed in given areas within a screen.

As shown in FIG. 9, when the display area of the non-updated second image 903 overlaps the coordinate information of the display area of the updated first image 901 and the display area of the updated third image 905, plane units associated with the updated images may read the pixel data of the areas in which the images associated with the update are displayed through DMA. For example, the first plane unit 720 may read (931) the pixel data of the display area of the first image 510 (e.g., status bar). The second plane unit 910 may read (933) the pixel data of the first area (e.g., top area) of the display area of the second image 520 (e.g., wallpaper) that overlaps coordinate information of the display area of the first image 510. The third plane unit 730 may read (935) the pixel data of the display area of the third image 530 (e.g., popup player). The fifth plane unit 920 may read (937) the pixel data of the second area (e.g., bottom area) of the display area of the second image 520 (e.g., wallpaper), including an area overlapping the coordinate information of the display area of the third image 530.

When first coordinate information (e.g., source coordinate information) of a display area overlapping the coordinate information of the display area of the first image 901 and the coordinate information of the display area of the third image 905 is allocated to the plane units 910 and 920, only the pixel data of the overlapped display area not the entire display area of the second image can be read (933, 937).

The display controller 350 may change second coordinate information (e.g., destination coordinate information) of the display area of an image associated with an updated image, based on one of updated images. For example, the display controller 350 may change coordinate information of the display area of the updated third image 905, and second coordinate information (e.g., destination coordinate information) of the display area of the non-updated second image 903 that overlaps coordinate information of the display area of the first image 901 and the display area of the third image 905 and that has not been updated, based on coordinate information of the display area of the updated first image 901. For example, assuming that coordinate information of the display area of the first image 901 is (0, 0, 1440, 84), coordinate information of the display area of the second image 903 overlapping the coordinate information of the display area of the first image 901 is (0, 0, 1440, 2960), coordinate information of the display area of the third image 905 is (616, 2200, 640, 400), and coordinate information of the display area of the second image 903 overlapping the coordinate information of the display area of the third image 905 is (0, 2200, 1440, 2960), the display controller 350 may change the coordinate information of the display area of the third image 905 into (616, 84, 640, 400), may change coordinate information of the first area of the display area of the second image 903 that overlaps the coordinate information of the display area of the first image 901 into (0, 0, 1440, 84), and may change coordinate information of the second area of the display area of the second image 903 that overlaps the coordinate information of the display area of the third image 905 into (0, 84, 1440, 400), based on the coordinate information of the display area of the first image 901.

In FIG. 9, it has been described that the coordinate information of the display area of the second image 903 and the coordinate information of the display area of the third image 905 are changed based on the coordinate information of the display area of the first image 901, but the disclosure is not limited thereto. For example, the display controller 350 may change coordinate information of the display area of the first image 901 and coordinate information of the display area of the second image 903 that overlaps the coordinate information of the display area of the first image 901, and may change coordinate information of the display area of the first image 901 that overlaps coordinate information of the display area of the third image 905, such as change the coordinate information of the display area of the first image 901 from (0, 0, 1440, 84) to (0, 2116, 1440, 84), change coordinate information of the display area of the second image 903 overlapping the coordinate information of the display area of the first image 901 from (0, 0, 1440, 2960) to (0, 2116, 1440, 84), and change coordinate information of the display area of the first image 901 overlapping the coordinate information of the display area of the third image 905 from (0, 0, 1440, 2960) to (0, 2200, 1440, 400), based on coordinate information (e.g., (616, 2200, 640, 400)) of the display area of the third image 905.

Second coordinate information of the display area of an image associated with an updated image is changed based on one of updated images, images are combined based on the second coordinate information, and the combined images may be stored in a contiguous address of a memory.

The first plane unit 720, the second plane unit 910, the third plane unit 730, and the fifth plane unit 920 of the display controller 350 associated with an updated image may transmit (941, 943, 945, 947) the coordinate information of the display area of the updated first image 901, the changed coordinate information of the first area of the display area of the second image 903 that overlaps the coordinate information of the display area of the first image 901, the changed coordinate information of the display area of the updated third image 905, and the changed coordinate information of the second area of the display area of the second image 903 overlapping the coordinate information of the display area of the third image 905 to a combination unit 740 which may combine the first image 901, the second image 903, and the third image 905 based on the coordinate information (e.g., (0, 0, 1440, 84)) of the display area of the first image 901, the coordinate information (e.g., (0, 0, 1440, 84)) of the first area of the display area of the second image 903 overlapping the coordinate information of the display area of the first image 901, the changed coordinate information (e.g., (616, 84, 640, 400) of the display area of the third image 905, and the changed coordinate information (e.g., (0, 84, 1440, 400)) of the second area of the display area of the second image 903 overlapping the coordinate information of the display area of the third image 905.

For example, when a y value of coordinate information of the display area of the third image 905 and a y value of second coordinate information of the display area of the second image 903 including an area overlapping the coordinate information of the display area of the third image 905 are changed from 0 to 84, the combination unit 740 may combine the first image 901, the second image 903, and the third image 905 so that the display area of the third image 905 and the second area of the display area of the second image 903 overlapping the coordinate information of the display area of the third image 905 are disposed below the display area of the first image 901 and the first area of the display area of the second image 903 overlapping the coordinate information of the display area of the first image 901.

The display controller 350 may store the first image 901, the second image 903, and the third image 905, combined by the combination unit 740, in a contiguous address of the memory 360 (e.g., the second memory 360 of FIG. 3), for example, a FIFO memory.

The display controller 350 may transmit (951, 953) (0, 84, 1440, 168), that is, the coordinate information of the display area of the first image 901, (0, 0, 1440, 84), that is, the coordinate information of the first area of the display area of the second image 903 overlapping the coordinate information of the display area of the first image 901, (616, 2200, 640, 400), that is, the coordinate information of the display area of the third image 905 prior to the change, and (0, 2200, 1440, 400), that is, the coordinate information of the second area of the display area of the second image 903 prior to the change that overlaps the coordinate information of the display area of the third image 905, to the display 380 through a display interface (e.g., the display interface unit 365 of FIG. 3). The display 380 may display a plurality of images, including the updated first image 901 and third image 905, in a single screen form based on the coordinate information of the display area of the first image 901, the coordinate information of the display area of the second image 903, and the coordinate information of the display area of the third image 905 obtained from the display controller 350 through the display interface unit 365.

Figure 10:
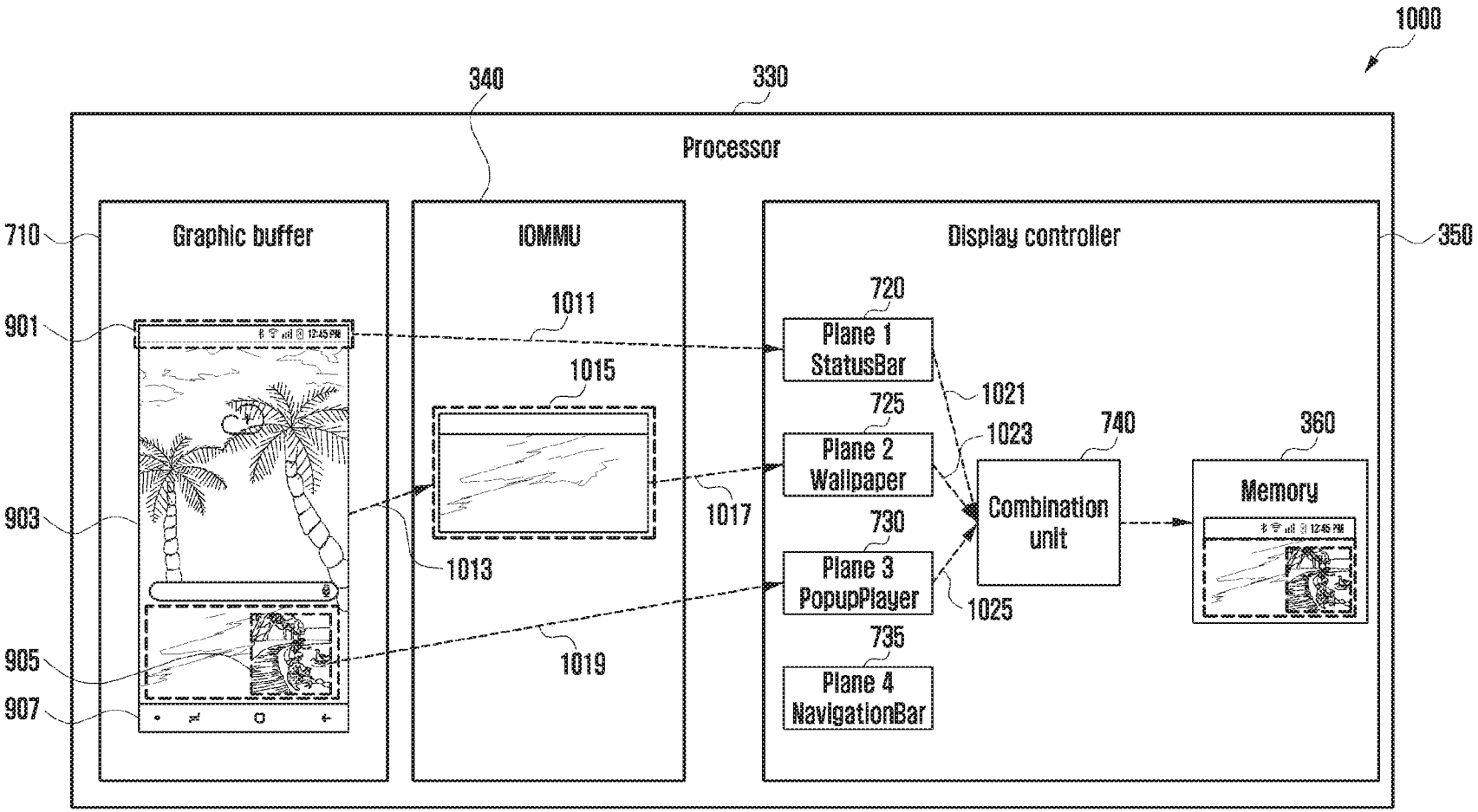
FIG. 10 illustrates a method of partially updating and displaying a screen according to an embodiment.

FIG. 10 illustrates a method of partially updating and displaying a screen according to an embodiment.

FIG. 10 illustrates a method of updating a first image 901 and a third image 905 using a virtual memory (e.g., the IOMMU 340) when the first image 901 and the third image 905 are updated and the display area of a not-update second image 520 overlaps coordinate information of the display area of the updated first image 901 and the display area of the updated third image 905.

Referring to FIG. 10, the processor 330 may display execution screen images for a plurality of applications in given areas within a screen of the display 380. The processor 330 may allocate given areas in which each of the plurality of screen images for the plurality of applications will be displayed.

The plurality of images may be displayed in the allocated area. In an embodiment, the plurality of images displayed in the allocated areas may be displayed in an overlap manner. For example, a plurality of images, for example, a first image 901 (e.g., status bar), a second image 903 (e.g., wallpaper), a third image 905 (e.g., popup player), and a fourth image 907 (e.g., navigation bar) may be displayed in given areas within a screen of the display 380. The first image 901 and the third image 905 may overlap the second image 903 when they are displayed in the given areas.

The display controller 350 may render the first image 901, the second image 903, the third image 905, and the fourth image 907, displayed in given areas within a screen, to the graphic buffer 710, and may allocate coordinate information of the display area of each of the first image to the fourth image 901, 903, 905, and 907 to a plane unit. For example, the display controller 350 may allocate coordinate information of the display area of the first image 901 to a first plane unit (Plane1) 720, may allocate coordinate information of the display area of the second image 903 to a second plane unit (Plane2) 725, may allocate coordinate information of the display area of the third image 905 to a third plane unit (Plane3) 730, and may allocate coordinate information of the display area of the fourth image 907 to a fourth plane unit (Plane4) 735.

The display controller 350 may detect the update of the first image 901 and the third image 905 displayed in given areas within a screen.

As shown in FIG. 10, when coordinate information of the display areas of the updated first image 901 and third image 905 overlaps some area of the display area of the second image 903 that has not been updated, the plane units of the updated images may read the pixel data of the areas in which the images associated with the update are displayed through direct memory access (DMA). For example, the first plane unit 720 may read (1011) the pixel data of the display area of the first image 901 (e.g., status bar), and the third plane unit 730 may read (1019) the pixel data of the display area of the third image 905 (e.g., popup player).

The processor 330 may remap (1013) coordinate information 1015 of some area of the display area of the second image 903, overlapping the coordinate information of the display area of the first image 901 and the coordinate information of the display area of the third image 905, to the IOMMU 340. For example, the processor 330 may remap (1013) coordinate information (e.g., (0, 2200, 1440 400)) of an area, overlapping the coordinate information of the display area of the third image 905, within the display area of the second image 903 to coordinate information (e.g., (0, 0, 1440, 84)) of an area, overlapping the coordinate information of the display area of the first image 901, within the display area of the second image 903 within the IOMMU 340 so that the virtual address of the coordinate information (e.g., (0, 2200, 1440 400)) and the virtual address of the coordinate information (e.g., (0, 0, 1440, 84)) are contiguously stored.

The second plane unit 725 may read (1017) the pixel data of some area 1015 of the display area of the second image 903 that overlaps the remapped coordinate information 1013 of the display area of the first image 901 and the display area of the third image 905.

The first plane unit 720, the second plane unit 725, and the third plane unit 730 of the display controller 350 associated with updated images may transmit (1021, 1023, and 1025) the coordinate information of the display area of the updated first image 901, coordinate information of some area 1015 of the display area of the second image 903 overlapping the remapped coordinate information 1013 of the display area of the first image 901 and the display area of the third image 905, and changed coordinate information of the display area of the updated third image 905 to a combination unit 740.

For example, assuming that coordinate information of the display area of the second image 903 is (0, 0, 1440, 2960), the coordinate information of some area 1015 of the display area of the second image 903 transmitted (1023) to the combination unit 740 may include coordinate information, obtained by changing coordinate information (e.g., second coordinate information) of the display area of the second image 903 from (0, 0, 1440, 2960) to (0, 0, 1440, 484) based on the coordinate information of the display area of the first image 901 and the coordinate information of the display area of the third image 905. When the coordinate information of the display area of the second image 903 is changed into (0, 0, 1440, 484), it may be configured in the memory 360 (e.g., the second memory 360 of FIG. 3) of the display controller 350 as a new storage address.

The display controller 350 may store the first image 901, some area 1015 of the second image 903, and the third image 905, combined by the combination unit 740, in a contiguous address of the memory 360.

The display controller 350 may transmit (0, 0, 1440, 84), i.e., the coordinate information of the display area of the first image 901, (0, 0, 1440, 84) and (0, 2200, 1440, 400) that are the coordinate information of some area 1015 of the display area of the second image 903 overlapping the coordinate information of the display area of the first image 901, and (616, 2200, 640, 400), i.e., coordinate information of the display area of the third image 905 prior to the change, to the display 380 through a display interface (e.g., the display interface unit 365 of FIG. 3). The display 380 may display a screen, including the updated first image 901 and third image 905, based on the coordinate information of the display area of the first image 901, the coordinate information of some area of the display area of the second image 903, and the coordinate information of the display area of the third image 905 obtained from the display controller 350 through the display interface unit 365.

As seen in Table 1 below, current consumed when the output of two applications is updated based on the detection of the update of the two applications not including at least an overlap area within a single screen in FIGS. 3 to 10 is about 12 mA less than current consumed when the output of a non-updated application is updated in addition to the output of an updated application in the conventional art.

TABLE 1

| Conventional Art | Present Disclosure |
|---|---|
| 180.574 mA | 168.324 mA |

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The electronic device according to various embodiments of the disclosure can reduce current consumption and improve system performance because only the output of an actually updated application other than a non-updated application is updated.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device, comprising:

a display;

a memory; and a processor operatively connected to the memory and the display, wherein the processor is configured to:

combine a plurality of images based on an execution of a plurality of applications, resulting in the plurality of images being displayed in a single screen form, identify coordinate information of a display area of each of a first image and a second image on the screen based on the first image and second image belonging to the plurality of images and being updated, store the first image and the second image in a contiguous address of the memory, transmit the coordinate information of the display area of each of the first image and the second image and the stored first image and second image to the display, identify whether an area overlapping the coordinate information of the display area of each of the first image and the second image is present in a display area of a third image belonging to the plurality of images and not being updated, and change the coordinate information of the display area of the second image based on the coordinate information of the display area of the first image when an overlap area is not present.

2. The electronic device of claim 1, wherein the processor is further configured to:

combine the updated first image and second image based on the coordinate information of the display area of the first image and the changed coordinate information of the display area of the second image, and store the combined images in a contiguous address of the memory.

3. The electronic device of claim 1, wherein the processor is further configured to:

identify whether an area of the display area of the third image overlaps one of the coordinate information of the display area of the first image and the coordinate information of the display area of the second image, based on the overlap area being present.

4. The electronic device of claim 3, wherein the processor is further configured to:

change the coordinate information of the display area of the second image and coordinate information of the display area of the third image, the third image comprising an area overlapping the coordinate information of the display area of the second image, based on the coordinate information of the display area of the first image when the area of the display area of the third image overlaps one of the coordinate information of the display area of the first image and the coordinate information of the display area of the second image, and store the first image, the second image, and the third image overlapping the coordinate information of the display area of the second image in a contiguous address of the memory.

5. The electronic device of claim 3, wherein the processor is further configured to:

change coordinate information of the display area of the third image comprising an area overlapping the coordinate information of the display area of the first image, the coordinate information of the display area of the second image, and coordinate information of the display area of the third image comprising an area overlapping the coordinate information of the display area of the second image, based on the coordinate information of the display area of the first image, when the area of the display area of the third image overlaps each of the coordinate information of the display area of the first image and the coordinate information of the display area of the second image.

6. The electronic device of claim 5, wherein the processor is further configured to:

store the first image, the second image, and the third image overlapping the coordinate information of the display area of each of the first image and the second image in a contiguous address of the memory.

7. The electronic device of claim 3, further comprising a virtual memory, wherein the processor is further configured to:

remap the display area of the third image, comprising an area overlapping the coordinate information of the display area of each of the first image and the second image, to the virtual memory when the area of the display area of the third image overlaps each of the coordinate information of the display area of the first image and the coordinate information of the display area of the second image, change the coordinate information of the display area of the second image based on the coordinate information of the display area of the first image, and change coordinate information of the display area of the third image by reading the display area of the third image, remapped to the virtual memory, into the memory.

8. The electronic device of claim 1, wherein the processor is further configured to:

identify coordinate information of a display area of each of three or more of the plurality of images on the screen when an update of the three or more images occurs, identify a distance between the display areas of the three or more images, and merge some display area based on the identified distance, resulting in the display areas of the three or more images becoming the first image and the second image.

9. A method for an electronic device to partially update a screen, the method comprising:

combining a plurality of images based on an execution of a plurality of applications, resulting in the plurality of images being displayed in a single screen form;

identifying coordinate information of a display area of each of a first image and a second image on the screen based on the first image and second image belonging to the plurality of images and being updated;

storing the first image and the second image in a contiguous address of a memory; and transmitting the coordinate information of the display area of each of the first image and the second image and the stored first image and second image to the display;

identifying whether an area overlapping the coordinate information of the display area of each of the first image and the second image is present in a display area of a third image belonging to the plurality of images and not being updated, after identifying the coordinate information on the single screen; and changing the coordinate information of the display area of the second image based on the coordinate information of the display area of the first image when an overlap area is not present.

10. The method of claim 9, further comprising:

combining the updated first image and second image based on the coordinate information of the display area of the first image and the changed coordinate information of the display area of the second image.

11. The method of claim 9, further comprising:

identifying whether an overlap area of the display area of the third image overlaps one of the coordinate information of the display area of the first image and the coordinate information of the display area of the second image, based on the overlap area being present.

12. The method of claim 11, further comprising:

changing the coordinate information of the display area of the second image and coordinate information of the display area of the third image, the third image comprising an area overlapping the coordinate information of the display area of the second image, based on the coordinate information of the display area of the first image when the area of the display area of the third image overlaps one of the coordinate information of the display area of the first image and the coordinate information of the display area of the second image; and storing the first image, the second image, and the third image overlapping the coordinate information of the display area of the second image in a contiguous address of the memory.

13. The method of claim 11, further comprising:

changing coordinate information of the display area of the third image comprising an area overlapping the coordinate information of the display area of the first image, the coordinate information of the display area of the second image, and coordinate information of the display area of the third image comprising an area overlapping the coordinate information of the display area of the second image, based on the coordinate information of the display area of the first image when the area of the display area of the third image overlaps each of the coordinate information of the display area of the first image and the coordinate information of the display area of the second image.

14. The method of claim 13, further comprising:

storing the first image, the second image, and the third image overlapping the coordinate information of the display area of each of the first image and the second image in a contiguous address of the memory.

15. The method of claim 11, further comprising:

remapping the display area of the third image, comprising an area overlapping the coordinate information of the display area of each of the first image and the second image, to a virtual memory when the area of the display area of the third image overlaps each of the coordinate information of the display area of the first image and the coordinate information of the display area of the second image;

changing the coordinate information of the display area of the second image based on the coordinate information of the display area of the first image; and changing coordinate information of the display area of the third image by reading the display area of the third image, remapped to the virtual memory, into the memory.

16. The method of claim 9, further comprising:

identifying coordinate information of a display area of each of three or more of the plurality of images on the screen when an update of the three or more images occurs;

identifying a distance between the display areas of the three or more images; and merging some display area based on the identified distance, resulting in the display areas of the three or more images becoming the first image and the second image.

* * * * *